US007950795B2

(12) United States Patent
Ishikawa et al.

(10) Patent No.: US 7,950,795 B2
(45) Date of Patent: May 31, 2011

(54) IMAGE FORMING METHOD AND INK-JET RECORDING DEVICE UTILIZING PHOTO-CURABLE INK, AND INKSET, INK-JET RECORDING METHOD AND INK-JET RECORDING DEVICE UTILIZING PHOTO-CURABLE INK

(75) Inventors: Wataru Ishikawa, Hachioji (JP); Atsushi Nakajima, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 962 days.

(21) Appl. No.: 11/792,348

(22) PCT Filed: Nov. 18, 2005

(86) PCT No.: PCT/JP2005/021226

§ 371 (c)(1),
(2), (4) Date: Jun. 5, 2007

(87) PCT Pub. No.: WO2006/061981

PCT Pub. Date: Jun. 15, 2006

(65) Prior Publication Data

US 2008/0055379 A1 Mar. 6, 2008

(30) Foreign Application Priority Data

Dec. 9, 2004 (JP) ..... 2004-356538
Feb. 18, 2005 (JP) ..... 2005-041878

(51) Int. Cl.
*B41J 2/01* (2006.01)

(52) U.S. Cl. ..... 347/102; 347/100; 106/31.13; 106/31.27; 106/31.6

(58) Field of Classification Search ..... 347/100, 347/102; 106/31.13, 31.27, 31.6
See application file for complete search history.

(56) References Cited

U.S. PATENT DOCUMENTS

| | | | | |
|---|---|---|---|---|
| 2003/0199655 | A1 | 10/2003 | Yurugi et al. | |
| 2003/0222961 | A1 | 12/2003 | Nakajima | |
| 2005/0140765 | A1 * | 6/2005 | Masumi et al. | 347/102 |

FOREIGN PATENT DOCUMENTS

| | | | |
|---|---|---|---|
| JP | 06-200204 | A | 7/1994 |
| JP | 08-244254 | A | 9/1996 |
| JP | 10-044473 | A | 2/1998 |
| JP | 2000-504778 | A | 4/2000 |
| JP | 2001-220526 | A | 8/2001 |
| JP | 2002-188025 | A | 7/2002 |
| JP | 2002-317139 | A | 10/2002 |
| JP | 2003-055449 | A | 2/2003 |
| JP | 2003-342503 | | 3/2003 |
| JP | 2004-285216 | A | 10/2004 |
| WO | WO 2004/056581 | A1 | 7/2004 |

* cited by examiner

*Primary Examiner* — K. Feggins
*Assistant Examiner* — Rut Patel
(74) *Attorney, Agent, or Firm* — Holtz, Holtz, Goodman & Chick, P.C.

(57) ABSTRACT

An ink-jet recording device which is equipped with a recording head to eject one type or plural types of inks containing a photo-curable component onto a recording medium and a light irradiation device to cure the ink by irradiating light onto the ink having deposited on the recording medium, wherein ink quantity cured by one time light irradiation is not less than 5 g/m$^2$, and an amount of a photo-polymerization initiator in the ink is not more than 5 weight % based on the total weight of the ink.

6 Claims, 5 Drawing Sheets

IMAGE FORMING METHOD AND INK-JET RECORDING DEVICE UTILIZING PHOTO-CURABLE INK, AND INKSET, INK-JET RECORDING METHOD AND INK-JET RECORDING DEVICE UTILIZING PHOTO-CURABLE INK

This application is the United States national phase application of International Application PCT/JP2005/021226 filed Nov. 18, 2005.

FIELD OF THE INVENTION

The present invention relates to (A) an image forming method and an ink-jet recording device, which utilize photo-curable ink and are capable of high speed printing, and (B) an ink-jet recording method and an ink-jet recording device, which utilize color photo-curable ink, and are capable of high speed printing and improved image adhesion to the substrate, depression of curing wrinkles and surface texture.

BACKGROUND OF THE INVENTION (A) Heretofore, a curable ink composition, which is cured by actinic rays such as ultraviolet rays and electron rays, or by heat, has been utilized in practice for various applications such as paints, adhesives and printing inks onto such as plastic, paper, wood and inorganic materials, as well as printed circuit board and electric insulation related matters. In recent years, as for printing inks, paints and adhesives among them, further improvement of weather-proofing and adhesion capability has been desired. Further, as ink-jet ink utilizing them, photo-curable ink, which is cured by actinic rays such as ultraviolet rays, is known. An ink-jet method utilizing this ultraviolet curable ink has attracted attention in recent years with respect to relatively low odor, rapid drying and the capability of recording on a recording material without an ink absorptive property, and ultraviolet curable ink-jet ink has been disclosed in such as JP-A 6-200204 (hereinafter, JP-A refers to Unexamined Japanese Patent Application Publication No.) and Japanese Translation of PCT International Patent Application Publication No. 2000-504778.

With respect to these photo-curable inks, an ink employing a radical polymerizing compound, and further an ink employing a cationic polymerizing compound which does not exhibit a polymerization inhibition effect due to oxygen, have been studied (for example, please refer to Patent Documents 1-4).

However, in the case of forming an image by use of ultraviolet curable ink-jet ink, insufficient curing tends to be caused when a large an ink quantity is to be cured during one time ultraviolet irradiation. This is because of deterioration of the interior curing capability due to the increased ink layer thickness. However, it is necessary to increase the ink quantity per one time ejection to improve productivity, however, insufficient curing tends to result due to a heavier ink layer thickness. Further, this problem is more significantly exhibited in the case of a line printer.

(B) An ultraviolet curable ink-jet recording method can perform image formation on various substrates as described before and is increasingly attracting attention. In the ink-jet recording method, there are a serial recording method, which forms an image by dividing the image and overlaying the thinned-out images, and a line recording method, which forms an image with a single pass, and both methods are also realized in an ultraviolet curable ink-jet recording method.

In the case of forming a color image by the ultraviolet curable ink-jet recording method, there are an exposure method to irradiate ultraviolet rays for each color to be consecutively cured and an exposure method to irradiate ultraviolet rays onto plural colors at once, in both the serial recording method and the line recording method. Since in an apparatus to irradiate ultraviolet rays onto each color requires plural light sources, a rise in apparatus size and overall cost up result.

The ultraviolet curable ink-jet recording method is suitable for high speed printing because ink is dried instantly by irradiation of ultraviolet rays. However, the uncured ink quantity after irradiation of ultraviolet rays necessarily increases when a higher printing speed is employed. In a serial print method, it is the case that recording is performed with a reduced number of passes.

In Patent Documents 5 and 6, since bleeding among multicolors tends to be caused when the ink volume is large, proposed is a method in which the ink adhesion quantity of the finally formed image is limited by utilizing inks of seven colors comprising Y, M, C, K, R, G, and B, which includes secondary colors. This is a technology proposed to prevent color mixture of ink, since the ink absorption rate by a substrate decreases with increased deposited ink quantity. In Patent Documents 5 and 6, there is no description concerning ultraviolet curable ink.

In an ultraviolet curable ink-jet recording method, since ink is cured on the substrate surface without being allowed to be absorbed by the substrate, no problems are caused as hitherto with respect to ink absorption. However, when ultraviolet rays are irradiated onto drops of large ink volume, ultraviolet rays, which contributes to a chemical reaction, do not penetrate to the interior, resulting in deteriorated interior curing and poor adhesion of the ink to the substrate, which is a characteristic problem of ultraviolet curable ink. Further, depending on ink composition and adhered ink volume, only the surface is cured to cause stress between the interior and the surface resulting in generation of curing wrinkles. These phenomena are significant with black ink which has a high light blocking effect against ultraviolet rays. Further, these phenomena also vary greatly depending on the added amount of a polymerization initiator which contributes to curing sensitivity, and absorption of ultraviolet rays is increased when the amount of a polymerization initiator is increased to increase curing sensitivity, which often deteriorates the interior curing capability.

Surface texture will be increased when ink deposition volume is increased due to mixing of colors, and not only surface texture but also visual sensation of quality such as glossiness differs between the highlighted areas and the shadowy areas.

These phenomena tend to be caused with ink having a high light blocking effect against ultraviolet rays depending on such factors as types and density of the colorant utilized in the ink, and ink having a high additive rate of a polymerization initiator, however, these phenomena also vary depending on the type of reaction. Specifically, in cationic polymerizable ink, which exhibits no polymerization inhibition to oxygen and exhibits a high surface curing capability, the above-described phenomena are significant factors which require improvement.

[Patent Document 1] JP-A (hereinafter, JP-A refers to Unexamined Japanese Patent Application Publication No.) 2001-220526 (claims, examples)

[Patent Document 2] JP-A 2002-188025 (claims, examples)

[Patent Document 3] JP-A 2002-317139 (claims, examples)

[Patent Document 4] JP-A 2003-55449 (claims, examples)
[Patent Document 5] JP-A 10-44473
[Patent Document 6] JP-A 8-244254

SUMMARY OF THE INVENTION

Problems to be Solved

This invention has been achieved in view of the above-described problems, and the objects are to provide: (A) an image forming method and an ink-jet recording device which exhibit no deterioration of curing capability nor deterioration of curing capability even when printing at a high rate as with a line printer, and to provide (B) an ink-jet recording method, an ink set and an ink-jet recording device which are capable of high rate printing, exhibit no deterioration of curing capability, and exhibit improved adhesion to the substrate, as well as suppression of curing wrinkles and roughened image texture.

Means to Solve the Problems

First object (A) of this invention described above has been achieved by following constitutions of Items (1)-(16), and second object (B) has been achieved by following constitutions of Items (17)-(23).

Item (1) An ink-jet recording device which is equipped with a recording head to eject one type or plural types of ink containing a photo-curable component onto a recording medium and a light irradiation device to cure ink by irradiation of light on the deposited ink onto the aforesaid recording medium, wherein ink quantity to be cured at one time irradiation is not less than 5 g/m$^2$ and an amount of a polymerization initiator in said ink is not more than 5 weight % based on the total weight of the ink.

Item (2) The ink-jet recording device described in above Item (1), wherein ink quantity cured by one time of light irradiation is not less than 10 g/m$^2$.

Item (3) The ink-jet recording device described in above Item (2), wherein an amount of a polymerization initiator in the aforesaid ink is not more than 3 weight %.

Item (4) The ink-jet recording device described in any one of above Items (1)-(3), wherein a photo-curable component is a cationic polymerizing compound.

Item (5) The ink-jet recording device described in above Item (4), wherein an epoxy compound and a compound having an oxetane ring are incorporated as the aforesaid cationic polymerizing compound.

Item (6) The ink-jet recording device described in above Item (5), wherein the added amount of the aforesaid epoxy compound in the ink is at least 30 weight %.

Item (7) The ink-jet recording device described in any one of above Items (1)-(6), wherein actinic rays are irradiated within 0.001-0.1 second after the aforesaid ink has been deposited.

Item (8) The ink-jet recording device described in any one of above Items (1)-(7), wherein ejection is performed after the aforesaid ink and recording head have been heated to 35-100° C.

Item (9) An image forming method in which one type or plural types of ink containing a photo-curable component are ejected from a recording head onto a recording medium and the ink having been deposited on the aforesaid recording medium is cured by light irradiation to form an image, wherein ink quantity cured by one time light irradiation is not less than 5 g/m$^2$ and an amount of a polymerization initiator in said ink is at most 5 weight %.

Item (10) The image forming method described in above Item (9), wherein ink quantity cured by one time of light irradiation is at least 10 g/m$^2$.

Item (11) The image forming method described in above Item (9) or (10), wherein an amount of a polymerization initiator in the aforesaid ink is at most 3 weight %.

Item (12) The image forming method described in any one of Items (9)-(11), wherein the photo-curable component is a cationic polymerizing compound.

Item (13) The image forming method described in above Item (12), wherein an epoxy compound and a compound having an oxetane ring are incorporated as the aforesaid cationic polymerizing compound.

Item (14) The image forming method described in above Item (13), wherein the added amount of an epoxy compound in ink is at least 30 weight %.

Item (15) The image forming method described in any one of above Items (9)-(14), wherein actinic rays are irradiated within 0.001-0.1 second after deposition of aforesaid ink.

Item (16) The image forming method described in any one of above Items (9)-(15), wherein ejection is performed after the aforesaid ink and recording head have been heated at 35-100° C.

Item (17) An ink-jet recording method in which plural colors of ink are applied onto a substrate and said ink is fixed by irradiation of ultraviolet rays, wherein any uncured ink volume on the substrate at the time of irradiation of ultraviolet rays is limited to make an ultraviolet transmittance at the absorption peak wavelength at least 0.1%.

Item (18) An ink-jet recording method in which plural colors of ink are applied onto a substrate and said ink is fixed by ultraviolet irradiation, wherein the total applied ink of each color in a final image is limited to at most the total applied ink in a solid image of each color.

Item (19) The ink-jet recording method described in Item (17) or (18), wherein ink of the seven colors of yellow, magenta, cyan, black, blue, green and red are utilized as the aforesaid plural color inks.

Item (20) An ink set which is comprised of ink of plural colors utilized in an ink-jet recording method described in any one of Items (17)-(19), wherein ultraviolet transmittance of a solid image (ink), with respect to each ink of all the plural colors, is at least 0.1%.

Item (21) The ink set described in above Item (20), wherein ink of the seven colors of yellow, magenta, cyan, black, blue, green and red are utilized as the aforesaid plural color inks.

Item (22) An ink-jet recording device characterized in that an ultraviolet transmittance of a solid image (ink), with respect to each ink of the plural colors, is at least 0.1% and recording is performed by an ink-jet recording device described in any one of Items (17)-(19).

Item (23) The ink-jet recording device described in Item (22), wherein ink of the seven colors of yellow, magenta, cyan, black, blue, green and red are utilized as the aforesaid plural color inks.

Effects of the Invention

The invention according to above Items (1)-(17) can provide an image forming method and an ink-jet recording device which exhibit no deterioration of curing capability even in the case of an ink layer of a large thickness is cured by one time irradiation of actinic rays, nor deterioration of curing capability in the case of high rate printing.

Further, inventions according to Items (18)-(22) can provide an ink-jet recording method, an ink set and an ink-jet recording device which utilize ultraviolet-curable color ink, capable of a high rate printing, and exhibit improved adhesion to the substrate, as well as in suppression of curing wrinkles and rough image texture.

DESCRIPTION OF THE ALPHA-NUMERIC DESIGNATIONS

Figure 1:
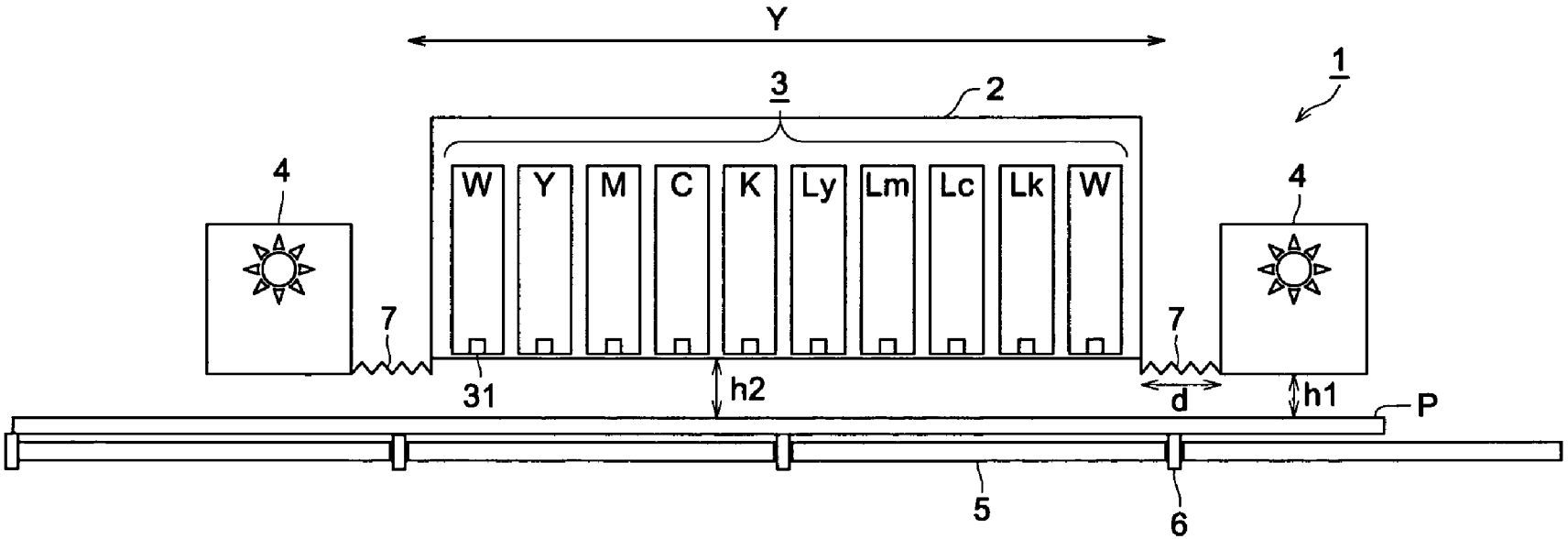
FIG. 1 is a front view showing an example of one constitution of the primary portion of the ink-jet recording device of this invention.

1: Recording device
2: Head carriage
3: Recording head
31: Ink ejection outlet
4: Irradiation means
5: Platen portion
6: Guide member
7: Bellows
P: Recording material (Substrate)

DETAILED DESCRIPTION OF THE INVENTION

The inventors of this invention have achieved this invention as a result of extensive study in regard to the above-described problems. In the following, the invention described in above Items (1)-(16), and the invention described in above Items (17)-(22) will be further explained.

First, with respect to the invention described in above Items (1)-(16), the most preferable embodiments to practice this invention will be explained; however, this invention is not limited thereto.

The invention described in Items (1)-(16) is an image forming method in which one type or plural types of ink containing a photo-curable component are ejected onto a recording material from a recording head and the ink having been deposited on the aforesaid recording material is cured by irradiation of light to form a permanent image.

An image forming method in which, photo-curable ink, after being ejected onto a substrate by means of an ink-jet method, is cured by actinic rays such as ultraviolet rays or electron rays to form an image (or text characters), is suitable for printing an image or text character on a substrate such as plastic since the method can form an image exhibiting good adhesion even on a non-absorptive substrate.

In image formation by ink-jet recording, to increase productivity, it is necessary to increase ink ejection quantity per pass to form an image on a substrate. To deposit a relatively large quantity of ink on a substrate and cure that ink by irradiation of actinic rays such as ultraviolet rays, requires a means to increase photo-polymerization sensitivity by increasing the amount of a polymerization initiator, a means to increase the irradiation amount of the actinic rays, or a means to more efficiently utilize these means.

In the present state, in image drawing by means of an ink-jet method employing photo-curable ink, an image is formed by a method to assure the required ink quantity for an image by at least two plural passes, wherein ink ejection and consecutive light irradiation are repeated. In this case, ink quantity cured by one time light irradiation is at most 5 g/m$^2$.

In view of efficiency of image printing (being image formation), it is the more preferable that ink quantity cured by one time light irradiation is larger, however, at present such problems as wrinkles on the image surface and adhesion to the substrate have not been solved. When ink quantity cured by one time light irradiation is at least 5 g/m$^2$, or when an ink layer formed on a substrate is cured by a method employing such as one pass and a line type printing head, particularly in the case of cationic polymerizable ink.

This is a dramatic phenomenon, specifically with respect to the curing reaction of cationic polymerizable ink by light irradiation, and the curing reaction of an ink layer or a liquid ink drop by actinic rays is easily achieved on the surface, and is often insufficient in the interior of an ink layer because actinic rays barely penetrate into the layer's interior. Therefore, particularly in the case of cationic polymerizable ink, when a relatively large quantity of ink must be cured by one time irradiation of actinic rays, the phenomena of wrinkles on the image surface and insufficient adhesion to the substrate are very problematic due to the extreme difference of required curing degrees between the surface and the interior of the deposited ink. Although curing effectively proceeds on the ink layer surface, polymerization does not proceed enough in the ink interior even with increased light intensity of the actinic rays nor increased polymerization sensitivity, by increasing the amount of such as a polymerization initiator.

That is, even with increased polymerization sensitivity, in the case of a relatively large ink layer thickness, a big difference results in curing via polymerization between the surface and the interior of the deposited ink and this imbalance between curing of the ink surface and the interior will cause phenomena of such as wrinkles on the image surface and insufficient adhesion between ink and substrate even after typical light irradiation. Further, a problem such as twisting of an image also tends to be generated. These phenomena in the case of utilizing photo-curable ink cannot be eliminated by increased illuminance of actinic rays nor an increased amount of a polymerization initiator. On the contrary, the difference between curing rate at the ink surface and that of the interior may increase resulting in increased wrinkling of the image, and it is assumed that there is now no effective means with respect to improvement of adhesion because curing does not proceed as fast within the interior.

The invention described in Items (1)-(16) exhibits preferable effects particularly in cationic polymerizable ink. It is preferable that cationic polymerizable ink cures stably because polymerization does not suffer due to exposure to oxygen in ambient air, and it is specifically preferable to employ this invention since cationic polymerizable ink exhibits a tendency of a higher curing reaction rate of the deposited ink surface compared to the interior due to no suppression of polymerization reaction on the surface, and also because a curing rate is somewhat slower than that of radical polymerization ink.

Therefore, in the invention described in Items (1)-(16), it was found that in an image forming method or an ink-jet recording device in which one type or plural types of ink containing a photo-curable component are ejected onto a recording medium from a recording head, and ink having been deposited onto the aforesaid recording medium is cured by irradiation of light to form a permanent image. Further, at the time of ink-jet image formation by ejection so as to produce a relatively thick ink layer which is cured by one time light irradiation of at most 5 g/m$^2$ and preferably at least 5 g/m$^2$ and at most 20 g/m$^2$, it is preferable to set the amount of a polymerization initiator in said ink to be less than 5 weight % based on the total ink weight and preferably at least 0.1 weight % and less than 5 weight %, with respect to forming an image which hardly ever causes image wrinkling or film peel-off. Furthermore preferable effects are exhibited when the ink quantity cured by one time light irradiation is at least 10 g/m$^2$, and the amount of polymerization initiator is further preferably in the range of 0.5-3.0 weight %. Thereby, the curing reaction (being polymerization) rate difference is suppressed into the predetermined range, and an ink-jet image, of no image wrinkling and good adhesion to the substrate showing good ink layer adhesiveness, can be easily formed. For example, since the amount of a polymerization initiator is somewhat suppressed, it is preferable to employ a light source having an illuminance (energy level) as high as at least 1 kW·hr based on the total power consumption.

When the amount of a polymerization initiator is at least 5 weight %, first only the surface is cured and the curing of the interior is delayed and so-called imbalance of curing is increased which increases wrinkling of the image surface, while adhesion to the substrate suffers. Further, when the amount of a polymerization initiator is not more than 0.1 weight %, decrease of a polymerization rate become large to make it difficult to form a sufficiently cured image by one time of irradiation of actinic rays, and efficiency of image formation is decreased. Further, wrinkles of an image and poor adhesion to the substrate are similarly induced and durability of an image is deteriorated, which is not preferable.

(Light Irradiation Condition After Ink Deposition)

In an image forming method utilizing an ink-jet recording device according to this invention described in Items (1)-(16), irradiation of actinic rays is performed after ink is adhered on a substrate (being a recording material). Irradiation of actinic rays may be visible light irradiation or ultraviolet irradiation, and is specifically preferably ultraviolet irradiation.

In an image forming method of this invention, as an irradiation condition of actinic rays, actinic rays are preferably irradiated within 0.001-1 second after ink deposition and more preferably within 0.001-0.5 seconds. It is specifically important to make an irradiation timing as early as possible. Actinic rays include such as ultraviolet rays and electron rays, and preferable among them are ultraviolet rays.

In the invention described in Items (1)-(16), a light source is preferably one having a high illuminance of not less than 1 kW·hr based on the total power consumption so as to supply a sufficient energy by one time of irradiation.

For example, in the case of ultraviolet irradiation, it is performed at ultraviolet irradiation quantity in a range of not less than 100 mJ/cm$^2$ and preferably of not less than 500 mJ/cm$^2$, and not more than 10,000 mJ/cm$^2$ and preferably not more than 5,000 mJ/cm$^2$. At the aforesaid amount of a polymerization initiator in ink, it is advantageous since curing reaction can be sufficiently performed and fading of a colorant by irradiation of ultraviolet rays can be prevented. A light source of ultraviolet irradiation includes such as a metal halide lamp, a xenon lamp, a carbon arc tube, a chemical lamp, a low pressure mercury lamp, a high pressure mercury lamp. For example, such as H lamp, D lamp or V lamp manufactured by Fusion System Corp., which is available on the market can be utilized.

Among them, a metal halide lamp has a continuous spectrum compared to a high pressure lamp (primary wavelength is 365 nm), a higher efficiency of emission in a range of 200-450 nm and is rich in a long wavelength region. Therefore, when pigment is employed, as is the case of an actinic ray curable composition of this invention, a metal halide lamp is suitable.

Further, another light source includes such as a fluorescent lamp, a cold cathode tube, a hot cathode tube and an LED.

As an irradiation method of actinic rays, a basic method thereof is disclosed in JP-A 60-132767. According to this, preferable is a method in which light sources are provided on the both sides of a head unit and the head and light sources are scanned in a shuttle mode. Irradiation is performed leaving a predetermined time after ink deposition. Irradiation by another light source without drive may be further provided to complete curing. In U.S. Pat. No. 6,145,979, disclosed are a method employing an optical fiber and a method in which a collimated light source is incident into a mirror arranged on the side plane of a head unit and UV light is irradiated on the recording portion. In an image forming method of this invention, any of these irradiation methods can be utilized.

Further, it is also a preferable embodiment in which irradiation of actinic rays is divided into two steps to irradiate actinic rays by the aforesaid method firstly within 0.001-2 seconds after ink deposition and to further irradiate actinic rays after finishing the whole printing. By dividing actinic ray irradiation into two steps, it is possible to restrain shrinkage of a recording material which is caused at the time of ink curing.

As described above, according to the invention described in above Items (1)-(16), in an image forming by ink-jet recording utilizing photo-curable ink, even in the case of increased ink ejection quantity per one time to make ink quantity cured by one time of light irradiation of not less than 5 g/m$^2$, it is possible to increase productivity of image drawing without causing phenomena of such as wrinkles on the image surface and insufficient adhesion between ink and a substrate, due to a difference of curing rate between the ink surface and the interior.

Next, the invention described in above Items (17)-(22) will be detailed.

As a result of extensive study on the second object of this invention, it has been found that in an ink-jet recording method in which after plural colors of ink are applied on a substrate, said ink is fixed by irradiation of ultraviolet rays, achieved can be an ink-jet recording method capable of high speed recording and having been improved in adhesiveness on a substrate as well as in depressed curing wrinkles and roughness feeling, by limiting uncured ink quantity on a substrate at the time of ultraviolet irradiation within quantity so as to make ultraviolet transmittance at the absorption peak wavelength of a polymerization initiator of not less than 0.1%.

Further, it has been found that in an ink-jet recording method in which plural colors of ink are applied on a substrate and said ink is fixed by ultraviolet ray irradiation, achieved can be an ink-jet recording method capable of high speed recording and having been improved in adhesiveness on a substrate as well as in depressed curing wrinkles and roughness feeling, by limiting the total application quantity of each color ink in a final image to not more than ink quantity to give a solid image of one color. Ink quantity to give a solid image of one color is ink quantity to give the maximum density of one color.

In the following, the invention described in Items (17)-(23) will be detailed.

[Ink-jet Recording Method]

The invention described in above Items (17)-(23) is characterized by that ink application quantity at the time of ultraviolet irradiation is set to quantity to make the ultraviolet transmittance at the absorption peak wavelength of a polymerization initiator of not less than 1% and more preferably the total application quantity of each color ink in a final image is set to not more than quantity to give a solid image of one color.

Ultraviolet transmittance is measured at the absorption peak wavelength which contributes to a polymerization reaction. Specifically, an image is formed on a substrate having a high ultraviolet transmittance such as polypropylene and ultraviolet transmittance at the absorption peak wavelength of a polymerization initiator is measured by use of a spectrophotometer having an aperture of 10 mmϕ. Ultraviolet transmittance referred in this invention is not an ultraviolet transmittance of only a portion on a substrate where ink is applied but a mean ultraviolet transmittance of an image portion having a size of 10 mmϕ containing a portion without ink application.

In a serial recording method, ink is applied on a substrate by dividing an image in plural times and is cured. Therefore, when the division number is increased, that is, ink application quantity per one scan is decreased by increasing the pass number, and ink is cued by each one scan, ultraviolet transmittance of ink can be increased in one time of curing. However, in the case of not curing per one scan but collected irradiation of ultraviolet rays after image completion or recording at a high speed with a reduced pass number, it may not be always said sufficient. In a line recording, the condition is most difficult because uncured ink quantity becomes larger than that of a serial recording method.

The invention described in Items (17)-(23) is a recording method which limits ink application quantity at the time of ultraviolet irradiation to not less than 0.1% based on an ultraviolet transmittance. To realize this, preferable is a method to interlace an image or to limit ink quantity (application quantity) by increasing a content rate of a colorant, and specifically preferable is a method to utilize ink of seven colors comprising yellow, magenta, cyan, black, blue, green and red.

(Method to Utilize Inks of Seven Colors)

To make ink application quantity of the above-described range, it is preferable to utilize ink of seven colors comprising secondary colors of blue, green and red in addition to yellow, magenta, cyan and black.

Generally, in an ink-jet recording method to form a color image, ink of 3 colors comprising yellow ink (hereinafter, also referred to as Y), magenta ink (hereinafter, also referred to as M) and cyan ink (hereinafter, also referred to as C); or ink of 4 colors comprising black ink (hereinafter, also referred to as K) in addition thereto, are utilized.

In such an ink-jet recording method, in the case of ink ejection quantity to constitute one pixel being not variable, colors reproduced by one pixel are seven colors of Y, M, C, and red (hereinafter, also referred to as R) which is accumulation of Y and M, blue (hereinafter, also referred to as B) which is accumulation of M and C, green (hereinafter, also referred to as G) which is accumulation of C and Y, and black which is K or accumulation of Y, M and C; and a color (a color of such as paper, generally white) of a substrate (a recording material).

An ink-jet recording device forms a pixel by ejecting ink on a recording material, and in ultraviolet curable ink when ultraviolet rays are irradiated, since such as pixels of 3 colors of R, G and B, which are constituted of accumulation of ink of at least two colors, have more ink quantity per one pixel compared to pixels of Y, M and C, ultraviolet rays which contributes a reaction do not reach the interior to deteriorate the interior curing capability resulting in poor adhesion to the substrate or to cure only the surface to cause stress between the interior and the surface resulting in generation of curing wrinkles.

To solve the above-described problems, in an ink-jet recording method according to the invention described in Items (17)-(23), inks of 7 colors comprising Y, M, C, K, R, G and B are utilized and ink (after conversion) to be utilized for the pixel is determined from image data having been subjected to color separation (before conversion).

There are many conversion methods and a specific example will be shown below, however, this invention is not limited thereto.

For example, based on image data (before conversion) having been subjected to color separation into 3 colors comprising Y, M and C, according to a conversion table of Table 1, a pixel in which Y and M are accumulated is replaced by R, a pixel in which M and C are accumulated is replaced by B, a pixel in which C and Y are accumulated is replaced by G, and a pixel in which Y, M and C are accumulated is replaced by K.

TABLE 1

| | Before conversion | | | After conversion | | | | | | | Total |
|---|---|---|---|---|---|---|---|---|---|---|---|
| Color | Y | M | C | Y | M | C | K | R | G | B | output |
| 1 | 0 | 0 | 0 | 0 | 0 | 0 | 0 | 0 | 0 | 0 | 0 |
| 2 | 0 | 0 | 1 | 0 | 0 | 1 | 0 | 0 | 0 | 0 | 1 |
| 3 | 0 | 1 | 0 | 0 | 1 | 0 | 0 | 0 | 0 | 0 | 1 |
| 4 | 0 | 1 | 1 | 0 | 0 | 0 | 0 | 0 | 0 | 1 | 1 |
| 5 | 1 | 0 | 0 | 1 | 0 | 0 | 0 | 0 | 0 | 0 | 1 |
| 6 | 1 | 0 | 1 | 0 | 0 | 0 | 0 | 0 | 1 | 0 | 1 |
| 7 | 1 | 1 | 0 | 0 | 0 | 0 | 0 | 1 | 0 | 0 | 1 |
| 8 | 1 | 1 | 1 | 0 | 0 | 0 | 1 | 0 | 0 | 0 | 1 |

0: no record,
1: record

Further, Table 2 is a conversion table to determine ink (after conversion) to be utilized in the pixel from image data (before conversion) having been subjected to a color separation into 4 colors of Y, M, C and K. An image color is converted into only K ink, irrespective to color data of Y, M and C, in the case of color data of K being "1" (record).

TABLE 2

| | Before conversion | | | | After conversion | | | | | | | Total |
|---|---|---|---|---|---|---|---|---|---|---|---|---|
| Color | Y | M | C | K | Y | M | C | K | R | G | B | output |
| 1 | 0 | 0 | 0 | 0 | 0 | 0 | 0 | 0 | 0 | 0 | 0 | 0 |
| 2 | 0 | 0 | 1 | 0 | 0 | 0 | 1 | 0 | 0 | 0 | 0 | 1 |
| 3 | 0 | 1 | 0 | 0 | 0 | 1 | 0 | 0 | 0 | 0 | 0 | 1 |
| 4 | 0 | 1 | 1 | 0 | 0 | 0 | 0 | 0 | 0 | 0 | 1 | 1 |
| 5 | 1 | 0 | 0 | 0 | 1 | 0 | 0 | 0 | 0 | 0 | 0 | 1 |
| 6 | 1 | 0 | 1 | 0 | 0 | 0 | 0 | 0 | 0 | 1 | 0 | 1 |
| 7 | 1 | 1 | 0 | 0 | 0 | 0 | 0 | 0 | 1 | 0 | 0 | 1 |
| 8 | 1 | 1 | 1 | 0 | 0 | 0 | 0 | 1 | 0 | 0 | 0 | 1 |
| 9 | 0 | 0 | 0 | 1 | 0 | 0 | 0 | 1 | 0 | 0 | 0 | 1 |
| 10 | 0 | 0 | 1 | 1 | 0 | 0 | 0 | 1 | 0 | 0 | 0 | 1 |
| 11 | 0 | 1 | 0 | 1 | 0 | 0 | 0 | 1 | 0 | 0 | 0 | 1 |
| 12 | 0 | 1 | 1 | 1 | 0 | 0 | 0 | 1 | 0 | 0 | 0 | 1 |
| 13 | 1 | 0 | 0 | 1 | 0 | 0 | 0 | 1 | 0 | 0 | 0 | 1 |
| 14 | 1 | 0 | 1 | 1 | 0 | 0 | 0 | 1 | 0 | 0 | 0 | 1 |
| 15 | 1 | 1 | 0 | 1 | 0 | 0 | 0 | 1 | 0 | 0 | 0 | 1 |
| 16 | 1 | 1 | 1 | 1 | 0 | 0 | 0 | 1 | 0 | 0 | 0 | 1 |

0: no record,
1: record

Based on data (before conversion) having been subjected to a color separation into 3 colors of R, G and B, for example, according to the conversion table of Table 3, a pixel in which R and B are accumulated is replaced by M, a pixel in which B and G are accumulated is replaced by C, a pixel in which R and G are accumulated is replaced by Y, a pixel in which all of R, G and B are no record is replaced by K, and a pixel in which R, G and B are accumulated is set to no record.

TABLE 3

| | Before conversion | | | After conversion | | | | | | | |
|---|---|---|---|---|---|---|---|---|---|---|---|
| Color | R | G | B | Y | M | C | K | R | G | B | Total output |
| 1 | 0 | 0 | 0 | 0 | 0 | 0 | 1 | 0 | 0 | 0 | 1 |
| 2 | 0 | 0 | 1 | 0 | 0 | 0 | 0 | 0 | 0 | 1 | 1 |
| 3 | 0 | 1 | 0 | 0 | 0 | 0 | 0 | 0 | 1 | 0 | 1 |
| 4 | 0 | 1 | 1 | 0 | 0 | 1 | 0 | 0 | 0 | 0 | 1 |
| 5 | 1 | 0 | 0 | 1 | 0 | 0 | 0 | 1 | 0 | 0 | 2 |
| 6 | 1 | 0 | 1 | 0 | 1 | 0 | 0 | 0 | 0 | 0 | 1 |
| 7 | 1 | 1 | 0 | 1 | 0 | 0 | 0 | 0 | 0 | 0 | 1 |
| 8 | 1 | 1 | 1 | 0 | 0 | 0 | 0 | 0 | 0 | 0 | 0 |

0: no record,
1: record

In addition to these, a method to determine ink (after conversion) utilized for the pixel from image data (before conversion) having been subjected to a color separation may be referred to JP-A 8-244254.

In the above embodiment, image data (before conversion) of 3 colors or 4 colors having been subjected to color separation are converted into data corresponding to inks of 7 colors by a control means of an ink-jet recording device.

Different from conventional inks of Y, M and C which are adjusted to reproduce hues of R, G and B by mixture of inks of Y, M and C, since ink exclusive to Y, M, C, R, G, B and K according to this invention does not require a consideration on utilization as a color mixture, ink can be prepared so that each color has an ideal hue.

In an ink-jet recording method of this invention according to Items (17)-(23), ink is ejected on a substrate to draw an image and successively the ink is cured by irradiation of ultraviolet rays.

In this invention, ink is preferably heated together with an ink-jet nozzle at the time of ejection to reduce viscosity of the ink liquid. The heating temperature is 30-80° C., and preferably 35-60° C.

In the invention described in Items (17)-(23), the total ink thickness after ink has deposited to be cured by irradiation of ultraviolet rays is preferably 2-20 μm. In a soft package printing field in which a substrate is often thin plastic material, since there is a problem of stiffness and/or sensation of quality of the whole printed matter in addition to curl and/or wrinkles of a substrate in the case of a large ink layer thickness, it is a specifically preferable application of this invention. Further, liquid drop quantity ejected from each nozzle is preferably 1-15 pl.

Further, to form an image having a high precision, it is the better when the irradiation timing is the earlier; however, it is preferable to start light irradiation at a timing when a viscosity of ink becomes preferable.

In more detail, as an irradiation condition of actinic rays, it is preferable to start irradiation of ultraviolet rays within 0.001-2.0 seconds after ink deposition, and more preferably within 0.001-0.4 seconds. Further, it is preferable to finish the irradiation after ultraviolet irradiation has been performed for 0.1-3 seconds, and more preferably for 0.2-1 second until fluidity of ink is lost. By adopting the above condition, enlargement of a dot diameter and bleeding among dots can be prevented.

As an irradiation method of ultraviolet rays, similar to the invention according to Items (1)-(16), the basic method is disclosed in JP-A 60-132767. According to this, light sources are arranged on the both sides of a recording head and the recording head and the light sources are scanned by a shuttle mode. Irradiation is performed leaving a predetermined time after ink deposition. Further, in U.S. Pat. No. 6,145,979 in which curing is completed by another light source without drive, as an irradiation method, disclosed are a method to utilize an optical fiber, and a method in which a collimated light source is incident on a mirror arranged on the side plane of a recording unit and UV light is irradiated on the recorded portion. In an ink-jet recording method of this invention, any of these irradiation methods can be utilized.

Further, it is also a preferable embodiment in which ultraviolet irradiation is divided into two steps and ultraviolet rays are firstly irradiated by the aforesaid method within 0.001-2.0 seconds after ink deposition, and ultraviolet rays are further irradiated after finishing the total printing. By dividing ultraviolet irradiation into two steps, it is possible to further depress shrinkage of a substrate caused at the time of ink curing.

As an examples of a light source utilized in ultraviolet irradiation, similarly to the invention according to Items (1)-(16), such as a mercury lamp, a metal halide lamp, an excimer laser, an ultraviolet laser, a cold cathode tube, a k-light, a LED (light emitting diode) can be applicable, and among them, preferable are a metal halide lamp, a cold cathode tube, a mercury lamp or a K-light because of low energy and/or low cost. With respect to a wavelength, a light source having a peak emission wavelength of 250-370 nm and preferably of 270-320 nm is preferable with respect to sensitivity. Illuminance is 1-3,000 mW/cm$^2$ and preferably 1-200 mW/cm$^2$.

[Ink]

An ink set utilized in an ink-jet recording method according to the invention described in Items (17)-(23) is preferably provided with an ultraviolet transmittance of a solid image of not less than 0.1% for all ink of plural colors. By this method, a polymerization initiator can obtain ultraviolet rays necessary for polymerization even under a difficult condition in which a plural number of ink are applied on the same pixel.

Further, an ink set of this invention preferably utilizes inks of 7 colors comprising Y, M, C, K, R, G and B as described before to make ink application quantity of the above described range.

In this invention, that is, in the invention described in Items (1)-(23), actinic ray (or light) curable ink is utilized.

Photo-curable ink utilized in this invention is prepared by employing a photo-polymerizing composition comprising a photo-polymerizable compound and a photo-polymerization initiator, and a colorant as basic components and by further appropriately incorporating an additive such as a dispersant, a surfactant, an image stabilizer, a polymerization inhibitor, a resin and a solvent.

Among photo-curable inks, a photo-polymerizing composition comprising a radical polymerizing compound and a radical polymerization initiator in radical polymerizing ink are utilized and a photo-polymerizing composition comprising a cationic polymerizing compound and an acid generator as a polymerization initiator in cationic polymerizable ink are utilized.

Radical polymerizing ink includes ink compositions described in such as JP-A 7-159983, Examined Japanese Patent Application Publication No. (hereinafter, referred to as JP-B) 7-31399, JP-A Nos. 8-224982 and 10-863.

Among photo-curable ink, first, a radical polymerizing compound utilized in radical polymerizing ink will be explained. A radical polymerizing compound utilized in radical polymerizing ink according to this invention is a compound having an ethylenic unsaturated bond which is capable of radical polymerization, and may be any of compounds provided having at least one ethylenic unsaturated bond being capable of radical polymerization in a molecule including a chemical form of such as monomer, oligomer and polymer. One type of a radical polymerizing compound may be utilized or a combination of at least two types at any ratio may be utilized to improve aimed characteristics.

A compound having an ethylenic unsaturated bond capable of radical polymerization includes radical polymerizing compounds such as unsaturated carboxylic acid such as acrylic acid, methacrylic acid, itaconic acid, crotonic acid, isocrotonic acid and maleic acid and salt thereof; ester, urethane, amide and anhydride thereof, acrylonitrile, styrene, various types of unsaturated polyester, unsaturated polyether, unsaturated polyamide and unsaturated urethane. Specifically, listed are acrylic derivatives such as 2-ethylhexylacrylate, 2-hydroxyethylacrylate, butoxyethylacrylate, carbitolacrylate, cyclohexylacrylate, tetrahydrofurfurylacrylate, benzylacrylate, bis(4-acryloxypolyethoxyphenyl)propane, neopentylglycolacrylate, 1,6-hexanedioldiacrylate, ethyleneglycoldiacrylate, diethyleneglycoldiacrylate, triethyleneglycoldiacrylate, tetraethyleneglycoldiacrylate, polyethyleneglycoldiacrylate, polypropyleneglycoldiacrylate, pentaerythritoltriacrylate, pentaerythritoltetraacrylate, dipentaerythritoltetraacryalte, trimethylolpropanetriacrylate, tetramethylolmethanetetraacrylate, oligoesteracrylate, N-methylolacrylamide, diacetonacylamide and epoxyacrylate; methacrylic derivatives such as methylmethacrylate, n-butylmethacrylate, 2-ethylhexylmethacrylate, laurylmethacrylate, allylmethacrylate, glycidyl metacrylate, benzylmethacrylate, dimethylaminomethacrylate, 1,6-hexanediol dimethacrylate, ethyleneglycol dimethacrylate, triethyleneglycol dimethacrylate, polyethyleneglycol dimethacrylate, polypropyleneglycol dimethacrylate, trimethylolethane trimethacrylate, trimethylolpropane trimethacrylate and 2,2-bis(4-methacryloxypolyethoxyphenyl) propane; in addition to derivatives of an allyl compound such as allylglycidyl ether, diallylphthalate and triallyltrimellitate; and further specifically, utilized can be radical polymerizing or cross-linking monomer, oligomer and polymer, which are available on the market or well known in the art, such as described in "Handbook of Cross-linking Agents" edited by Shinzo Yamashita (1981, Taiseisha); "Handbook of UV·EB Curing (Raw Materials)" edited by Seishi Kato (1985, Polymer Publishing Association); "Application and Market of UV·EB Curing Technology" edited by RadoTech Society, p. 79 (1989, CMC); and "Handbook of Polyester Resin" by Eiichi Takiyama (1998, Nikkan Kogyo News Paper Co.). The added amount of the above-described radical polymerizing compounds is preferably 1-97 weight % and more preferably 30-95 weight %.

As a radical polymerization initiator which constitutes a photo-polymerizing composition together with the above-described radial polymerizing compound, listed are triazine derivatives described in such as JP-B Nos. 59-1281 and 61-9621 and JP-A 60-60104; organic peroxides described in such as JP-A Nos. 59-1504 and 61-243807; diazonium compounds described in such as JP-B Nos. 43-23684, 44-6413, 47-1604 and U.S. Pat. No. 3,567,453; organic azide compound described in U.S. Pat. Nos. 2,848,328, 2,852,379 and 2,940,853; orthoquinone diazides described in such as JP-B Nos. 36-22062, 37-13109, 38-18015 and 45-9610; various types of onium compounds described in such as JP-B 55-39162 and JP-A 59-14023 and "Macromolecules" vol. 10, p. 1307 (1977); azo compounds described in JP-A 59-142205; metal allene complexes described in JP-A 1-54440, European Patent Nos. 109,851 and 126,712, and J. Imag. Sci. vol. 30, p. 174 (1986); (oxo)sulfonium organoboron complexes described in JP-A Nos. 4-213861 and 4-255347; titanocenes described in JP-A 61-151197; transition metal complexes containing a transition metal such as ruthenium described in JP-A 61-151197, "Corodination Chemistry Review" vol. 84, PP. 85-277 (1988) and JP-A 2-182701; 2,4,5-tiarylimidazole dimmer described in JP-A 3-209477; organic halogen compounds such as carbon tetrabromide and those described in JP-A 59-107344. These polymerization initiators are preferably incorporated in radical polymerizing ink in a range of not more than 5 weight % and preferably of 0.1-5 weight %.

Next, cationic polymerizable ink will be explained. Generally, as ultraviolet curable ink, a cationic polymerizing type has been noted because it has advantages of such as no polymerization inhibition by oxygen, little odor of a cationic polymerizing compound such as oxetane and epoxy among utilized cationic polymerizing compounds, and small curing shrinkage. Further, a cationic polymerizing type is characterized by high sensitivity even with a small liquid drop due to no deactivation of an active species by air, and is favorable for an application requiring high precision and high productivity. In this invention, ink of a cationic polymerizing type is preferably utilized.

As cationic polymerizable ink, various types of ink compositions well known in the art can be utilized. For example, listed are JP-A Nos. 6-9714, 2001-31892, 2001-40068, 2001-55507, 2001-310938, 2001-310937, 2001-220526 and 2004-131588.

A cationic polymerizing compound utilized in a photo-cationic polymerizable ink preferable in this invention will now be described.

A cationic polymerizing compound includes the following compound having an oxetane ring.

(Oxetane Compound Having 2-Position Substituted Oxetan Ring)

In photo-curable ink of this invention, an oxetane compound, which is provided with at least one 2-position substituted oxetane ring in a molecule, is preferably utilized.

Formula (1)

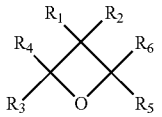

In above-described Formula (1), $R_1$-$R_6$ are each a hydrogen atom or a substituent. However, at least one of the groups represented by $R_1$-$R_6$ is a substituent. Substituents represented by $R_1$-$R_6$ in above-described Formula (1) include such as a fluorine atom, an alkyl group having a carbon number of 1-6 (such as a methyl group, an ethyl group, a propyl group and a butyl group), an fluoroalkyl group having a carbon number of 1-6, an allyl group, an aryl group (such as a phenyl group and a naphthyl group), a furyl group or a thienyl group. And these groups may be further provided with a substituent.

(Oxetane Compound Having One Oxetane Ring in Molecule)

Further, among above-described Formula (1), compounds provided with an oxetane ring such as represented by following Formulas (2)-(5) are preferably utilized.

Formula (2)

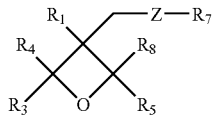

Formula (3)

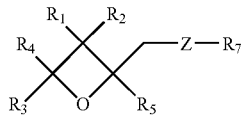

Formula (4)

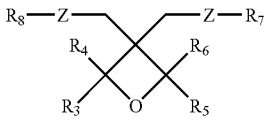

Formula (5)

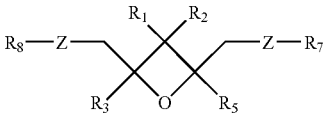

In the formula, $R_1$-$R_6$ are each a hydrogen atom or a substituent; $R_7$ and $R_8$ are each a substituent; and Z each independently is an oxygen or sulfur atom, or a divalent hydrocarbon which may contain an oxygen or sulfur atom in the main chain. Substituents represented by $R_1$-$R_6$ in Formulas (2)-(5) are identical to substituents represented by $R_1$-$R_6$ of Formula (1).

In Formulas (2)-(5), substituents represented by $R_7$ and $R_8$ include an alkyl group having a carbon number of 1-6 (such as a methyl group, an ethyl group, a propyl group and a butyl group), an alkenyl group having a carbon number of 1-6 (such as a 1-propenyl group, a 2-propenyl group, a 2-methyl-1-propenyl group, a 2-methyl-2-propenyl group, a 1-butenyl group, a 2-butenyl group and a 3-butenyl group), an aryl group (such as a phenyl group and a naphthyl group), an aralkyl group (such as a benzyl group, a fluorobenzyl group and a methoxybenzyl group), an acyl group having a carbon number of 1-6 (such as a propylcarbonyl group, a butylcarbonyl group and a pentylcarbonyl group), an alkoxycarbonyl group having a carbon number of 1-6 (such as an ethoxycarbonyl group, a propoxycarbonyl group and a butoxycarbonyl group), an alkylcarbamoyl group having a carbon number of 1-6 (such as a propylcarbamoyl group and a butylcarbamoyl group) and an alkoxycarbamoyl group (such as an ethoxycarbamoyl group).

In Formulas (2)-(5), an oxygen or sulfur atom, or a divalent hydrocarbon which may contain an oxygen or sulfur atom in the main chain, represented by Z, includes an alkylene group (such as an ethylene group, a trimethylene group, a tetramethylene group, a propylene group, an ethylethylene group, a pentamethylene group, a hexamethylene group, a heptamethylene group, an octamethylene group, a nonamethylene group and a decamethylene group), an alkenylene group (such as a vinylene group and a propenylene group), an alkenylene group (such as an ethynylene group and a 3-pentynylene group), and a carbon atom in the aforesaid alkylene group, an alkenylene group or an alkynylene group may be substituted by an oxygen atom or a sulfur atom.

In the above-described substituents, $R_1$ is preferably a lower alkyl group (such as a methyl group, an ethyl group and a propyl group) and specifically preferably an ethyl group. Further, $R_7$ and $R_8$ are preferably a propyl group, a butyl group, a phenyl group or a benzyl group, and Z is preferably a hydrocarbon group (such as an alkylene group, an alkenylene group or an alkynylene group) containing no oxygen or sulfur atoms.

(Compound Containing at least Two Oxetane Rings in Molecule)

Further, in this invention, a compound provided with at least two oxetane rings in the molecule, such as represented by following Formulas (6) and (7), can be utilized.

Formula (6)

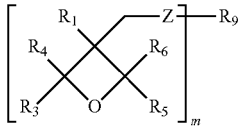

Formula (7)

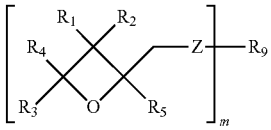

In the formula, Z is identical with a group utilized in aforesaid Formulas (2)-(5), and "m" is an integer of 2-4. $R_1$-$R_6$ is a hydrogen atom, a fluorine atom, an alkyl group having a carbon number of 1-6 (such as a methyl group, an ethyl group, a propyl group and a butyl group), a fluoroalkyl group having a carbon number of 1-6, an allyl group, an aryl group (such as a phenyl group and a naphthyl group), or a furyl group. Herein, in Formula (6), at least one of $R_3$-$R_6$ is a substituent.

In the formula, $R_9$ is a linear or branched alkylene group, or a linear or branched poly(alkyleneoxy) group, which have a carbon number of 1-12; or a divalent group selected from a group comprising following Formulas (9), (10) and (11).

As an example of the above-described branched alkylene group having a carbon number of 1-12, an alkylene group represented by following Formula (8) is preferably utilized.

Formula (8)

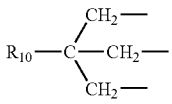

In the formula, $R_{10}$ is a lower alkyl group (such as a methyl group, an ethyl group and a propyl group).

Formula (9)

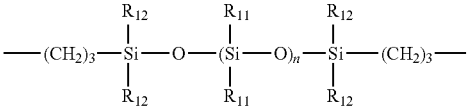

In the formula, n is 0 or an integer of 1-2,000, $R_{12}$ is an alkyl group having a carbon number of 1-10 (such as a methyl group, an ethyl group, a propyl group, a butyl group, a pentyl group, a hexyl group, a heptyl group, an octyl group and a nonyl group), $R_{11}$ is an alkyl group having a carbon number of 1-10 (such as a methyl group, an ethyl group, a propyl group, a butyl group, a pentyl group, a hexyl group, a heptyl group, an octyl group and a nonyl group) or a group represented by following Formula (12).

Formula (12)

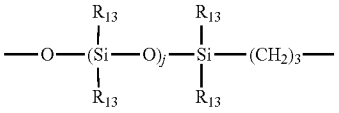

In the formula, j is 0 or an integer of 1-100, $R_{13}$ is an alkyl group having a carbon number of 1-10 (such as a methyl group, an ethyl group, a propyl group, a butyl group, a pentyl group, a hexyl group, a heptyl group, an octyl group and a nonyl group).

Formula (10)

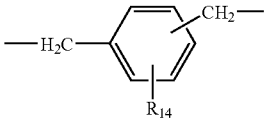

In the formula, $R_{14}$ is an alkyl group having a carbon number of 1-10 (such as a methyl group, an ethyl group, a propyl group, a butyl group, a pentyl group, a hexyl group, a heptyl group, an octyl group and a nonyl group), an alkoxy group having a carbon number of 1-10 (such as a methoxy group, an ethoxy group, a propoxy group, a butoxy group and a pentoxy group), a halogen atom (such as a fluorine atom, a chlorine atom, a bromine atom and an iodine atom), a nitro group, a cyano group, a mercapto group, an alkoxycarbonyl group (such as a methoxycarbonyl group, an ethoxycarbonyl group and a butoxycarbonyl group) or a carboxyl group.

Formula (11)

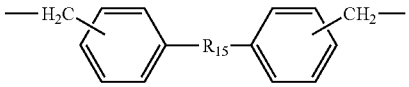

In the formula, $R_{15}$ is an oxygen atom, a sulfur atom, —NH—, —SO—, —$SO_2$—, —$CH_2$—, —$C(CH_3)_2$— or —$C(CF_3)_2$—.

As an embodiment of a preferable partial structure of a compound having an oxetane ring, which is utilized in this invention, for example, in above-described Formulas (6) and (7), $R_1$ is preferably a lower alkyl group (such as a methyl group, an ethyl group and a propyl group) and specifically preferably an ethyl group. Further, $R_9$ is preferably a hexamethylene group or above-described Formula (10) in which $R_{14}$ is a hydrogen atom.

In above-described Formula (8), $R_{10}$ is an ethyl group, $R_{12}$ and $R_{13}$ are a methyl group and Z is a hydrocarbon group containing no oxygen or sulfur atom.

Further, an example of a preferable embodiment of a compound having an oxetane ring includes compounds represented by following Formula (13).

Formula (13)

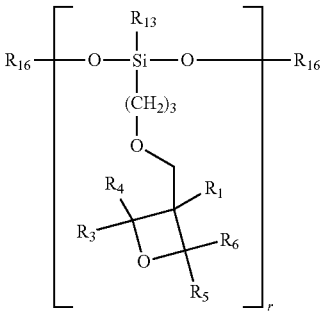

In the formula, r is an integer of 25-200, and $R_{16}$ is an alkyl group having a carbon number of 1-4 (such as a methyl group, an ethyl group, a propyl group and a butyl group) or a trialkylsilyl group. $R_1$, $R_3$, $R_5$ and $R_6$ are identical with substituents represented by $R_1$-$R_6$ in above-described Formula (1). Herein, at least one of $R_3$-$R_6$ is a substituent.

In the following, specific examples of a compound having an oxetane ring, the 2-position of which is substituted, will be shown as exemplary compounds 1-15, however, this invention is not limited thereto.

1: Trans-3-tert-butyl-phenyloxetane
2: 3,3,4,4-Tetramethyl-2,2-diphenyloxetane
3: Di[3-ethyl(2-methoxy-3-oxetanyl)]methyl ether
4: 1,4-Bis(2,3,4,4-tetramethyl-3-ethyloxetanyl)butane
5: 1,4-Bis(3-methyl-3-ethyloxetanyl)butane
6: Di(3,4,4-trimethyl-3-ethyloxetanyl)methyl ether
7: 3-(2-Ethyl-hexyloxymethyl)-2,2,3,4-tetramethyloxetane
8: 2-(2-Ethyl-hexyloxy)-2,3,3,4,4-pentamethyloxetane
9: 4,4-Bis[(2,4-dimethyl-3-ethyl-3-oxetanyl)methoxy]biphenyl
10: 1,7-Bis(2,3,3,4,4-pentamethyl-oxetanyl)heptane
11: Oxetanyl·silsesquioxane
12: 2-Methoxy-3,3-dimethyloxetane
13: 2,2,3,3-Tetramethyloxetane
14: 2-(4-Methoxyphenyl)-3,3-dimethyloxetane
15: Di(2-(4-methoxyphenyl)-3-methyloxetane-3-yl)ether Synthesis of a compound having an oxetane ring, at least the 2-position of which is substituted, according to this invention can be performed referring to the literatures described below.

1) Hu Xianming, Richard M. Kellogg, Synthesis, 533-538, May 2) A. O. Fitton, J. Hill, D. Ejane, R. Miller, Synth., 12, 1140 3) Toshiro Imai and Shinya Nishida, Can. J. Chem., vol. 59, 2503-2509 4) Nobujiro Shimizu, Shintaro Yamaoka, and Yuho Tsuno, Bull. Chem. Soc. Jpn., 56, 3853-3854 5) Walter Fisher and Cyril A. Grob, Helv. Chim. Acta., 61, 2336 6) Chem. Ber., 101, 1850 7) "Heterocyclic Compounds with Three- and Four-membered Rings", Part Two, Chapter IX, Interscience Publishers, John Wiley & Sons, New York 8) Bull. Chem. Soc. Jpn., 61, 1653 9) Pure Appl. Chem., A29, 915 10) Pure Appl. Chem., A30 (2 & amp; 3), 189 (1993)

11) JP-A 6-16804

12) German Patent No. 1,021,858

The content of a compound having an oxetane ring, at least the 2-position of which is substituted, in actinic ray curable ink-jet ink is preferably 1-97 weight % and more preferably 30-95 weight %.

(Combination Use of Oxetane Compound and Other Monomer)

Further, a compound having an oxetane ring, at least the 2-position of which is substituted, according to this invention may be utilized alone, however, may be also utilized in combination of two types having different structures, and a photo-polymerizable compound such as photo-polymerizing monomer or polymerizable monomer, which will be described later, can be utilized in combination. In the case of combination use, the mixing ratio is preferably adjusted to make the content of a compound having an oxetane ring, at least the 2-position of which is substituted, being 10-98 weight % in the mixture, and it is preferable to make the content of a polymerizing compound such as other photo-polymerizing monomer or polymerizing monomer of 2-90 weight %.

(Oxetane Compound Only 3-Position of Which is Substituted)

In this invention, an oxetane compound, the 2-position of which is substituted, described above can be utilized in combination with a conventionally well known oxetane compound and specifically preferably with an oxetane compound only the 3-position of which is substituted.

Herein, as an oxetane compound only the 3-position of which is substituted, utilized can be those well known in the art such as described in JP-A Nos. 2001-220526 and 2001-310937.

An oxetane compound, only the 3-position of which is substituted, includes compounds represented by following Formula (14).

Formula (14)

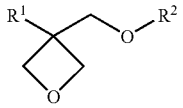

In the formula, $R^1$ is a hydrogen atom, an alkyl group having a carbon number of 1-6 such as a methyl group, an ethyl group, a propyl group and a butyl group; a fluoroalkyl group having a carbon number of 1-6, an allyl group, an aryl group, a furyl group or a thienyl group. $R^2$ is an alkyl group having a carbon number of 1-6 such as a methyl group, an ethyl group, a propyl group and a butyl group; an alkenyl group having a carbon number of 2-6 such as a 1-propenyl group, a 2-propenyl group, a 2-methyl-1-propenyl group, a 2-methyl-2-propenyl group, a 1-butenyl group, a 2-butenyl group and a 3-butenyl group; a group provided with an aromatic ring such as a phenyl group, a benzyl group, a fluorobenzyl group, a methoxybenzyl group and a phenoxyethyl group; an alkylcarbonyl group having a carbon number of 2-6 such as an ethylcarbonyl, a propylcarbonyl group and a butylcarbonyl group; an alkoxycarbonyl group having a carbon number of 2-6 such as an ethoxycarbonyl group, a propoxycarbonyl group and a butoxycarbonyl group; an N-alkylcarbonyl group having a carbon number of 2-6 such as an ethylcarbamoyl group, a propylcarbamoyl group, a butylcarbamoyl group and a pentylcarbamoyl group. As an oxetane compound utilized in this invention, a compound having one oxetane ring is specifically preferable with respect to excellent tackiness and a superior working property due to low viscosity.

An example of an oxetane compound provided with two oxetane rings includes compounds represented by following Formula (15).

Formula (15)

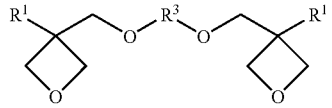

In Formula (15), $R^1$ is identical with those in above-described Formula (14). $R^3$ is a linear or branched alkylene group such as an ethylene group, a propylene group and a butylenes group; a linear or branched poly(alkyleneoxy) group such as a poly(ethyleneoxy) group and a poly(propyleneoxy) group; a linear or branched unsaturated hydrocarbon group such as a propenylene group, a methylpropenylene group and a butenylene group; or a carbonyl group or an alkylene group containing a carbonyl group; an alkylene group containing a carboxyl group or an alkylene group containing a carbamoyl group.

Further, $R^3$ includes also a polyvalent group selected from groups represented by following Formulas (16), (17) and (18).

Formula (16)

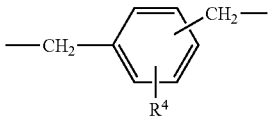

In Formula (16), $R^4$ is a hydrogen atom, an alkyl group having a carbon number of 1-4 such as a methyl group, an ethyl group, a propyl group and a butyl group; an alkoxy group having a carbon number of 1-4 such as a methoxy group, an ethoxy group, a propoxy group and a butoxy group; a halogen atom such as a chlorine atom and a bromine atom; a nitro group, a cyano group, a mercapto group, a lower alkoxycarbonyl group, a carboxyl group or a carbamoyl group.

Formula (17)

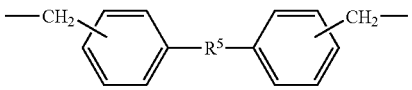

In Formula (17), $R^5$ is an oxygen atom, a sulfur atom, a methylene group, NH, SO, $SO_2$, $C(CF_3)_2$ or $C(CH_3)_2$.

Formula (18)

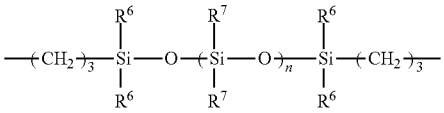

In Formula (18), $R^6$ is an alkyl group having a carbon number of 1-4 such as a methyl group, an ethyl group, a propyl group and a butyl group; or an aryl group. n is 0 or an integer of 1-2,000. $R^7$ is an alkyl group having a carbon number of 1-4 such as a methyl group, an ethyl group, a propyl group and a butyl group; or an aryl group. $R^7$ also includes a group selected from groups represented by following Formula (19).

Formula (19)

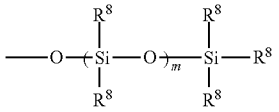

In Formula (19), $R^8$ is an alkyl group having a carbon number of 1-4 such as a methyl group, an ethyl group, a propyl group and a butyl group; or an aryl group. m is 0 or an integer of 1-100.

Specific examples of a compound having two oxetane rings include the following exemplary compounds.

Exemplary Compound 1

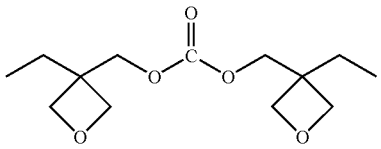

Exemplary Compound 2

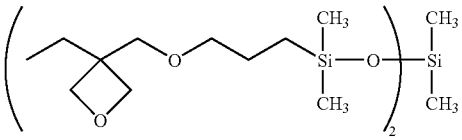

Exemplary compound 1 is a compound of aforesaid Formula (15) in which $R^1$ is an ethyl group and $R^3$ is a carboxyl group. Further, exemplary compound 2 is a compound of aforesaid Formula (15), in which $R^1$ is an ethyl group and $R^3$ is a compound of aforesaid Formula (18), in which $R^6$ and $R^7$ are a methyl group and n is 1.

In a compound having two oxetane rings, examples other than the above described compounds are compounds represented by following Formula (20). In Formula (20), $R^1$ is identical with $R^1$ in aforesaid Formula (14).

Formula (20)

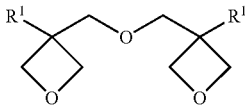

Further, an example of a compound having 3-4 oxetane rings includes compounds represented by following Formula (21).

Formula (21)

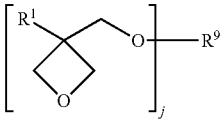

In Formula (21), $R^1$ is identical with $R^1$ in aforesaid Formula (14). $R^9$ includes a branched alkylene group having a carbon number of 1-12 such as groups represented by following A-C, a branched poly(alkyleneoxy) group such as groups represented by following D, or a branched poly(siloxy) group such as groups represented by following E. j is 3 or 4.

A

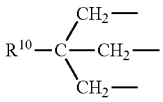

B

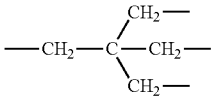

C

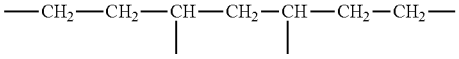

D

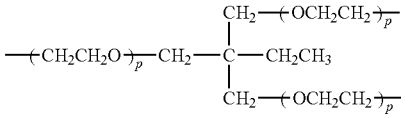

E

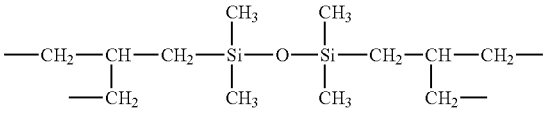

In above-described A, $R^{10}$ is a lower alkyl group such as a methyl group, an ethyl group and a propyl group. Further, in above-described D, p is an integer of 1-10.

An example of a compound having 3-4 oxetane rings includes exemplary compound 3.

Exemplary compound 3

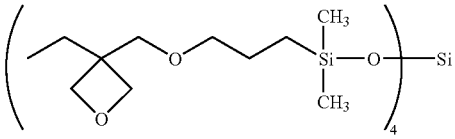

Further, an example of a compound having 1-4 oxetane rings other than those explained above includes compounds represented by following Formula (22).

Formula (22)

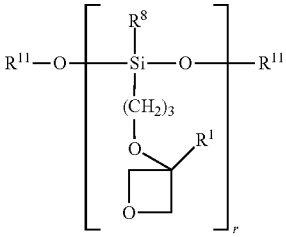

In Formula (22), $R^8$ is identical with $R^8$ in aforesaid Formula (19). $R^{11}$ is an alkyl group having a carbon number of 1-4 such as a methyl group, an ethyl group, a propyl group and a butyl group; or a trialkylsilyl group, and r is 1-4.

Preferable specific examples of an oxetane compound according to this invention include exemplary compounds 4, 5 and 6, which are described below.

Exemplary Compounds 4

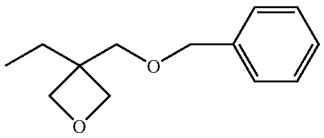

Exemplary Compounds 5

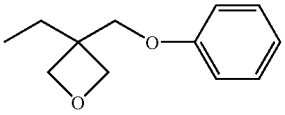

Exemplary Compounds 6

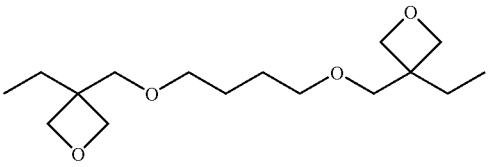

A manufacturing method of the above-described compounds having an oxetane ring is not specifically limited and may be referred to a conventionally well known method such as an oxetane ring synthesis method from diol, which is disclosed by D. B. Pattison (J. Am. Chem. Soc., 3455, 79 (1957)). Further, in addition to these, listed are compounds provided with 1-4 oxetane rings and having a high molecular weight of approximately 1,000-5,000. Specific example compounds thereof include following exemplary compounds 7-25.

Exemplary Compounds 7

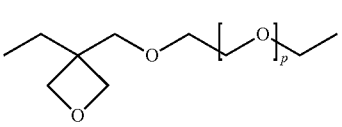

p:20~200

Exemplary Compounds 8

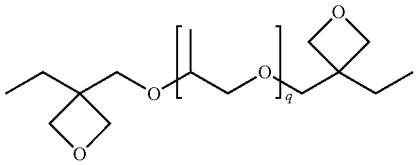

q:15~100

Exemplary Compounds 9

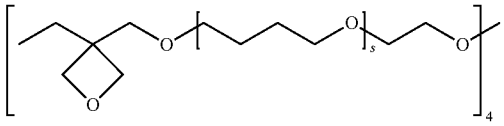

s:20~200

Exemplary Compounds 10

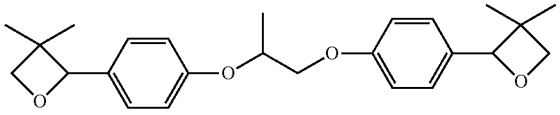

-continued

Exemplary Compounds 11

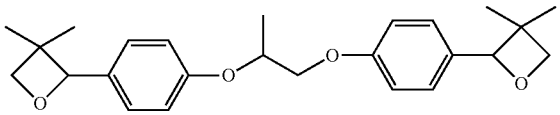

Exemplary Compounds 12

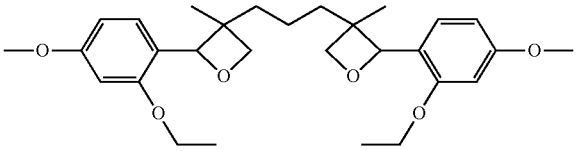

Exemplary Compounds 13

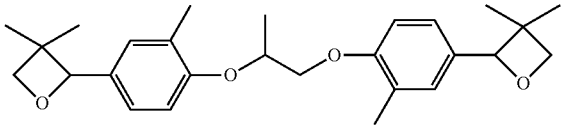

Exemplary Compounds 14

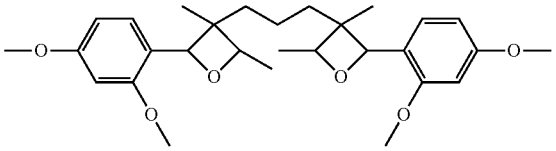

Exemplary Compounds 15

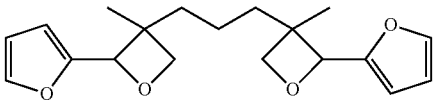

Exemplary Compounds 16

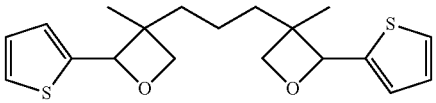

Exemplary Compounds 17

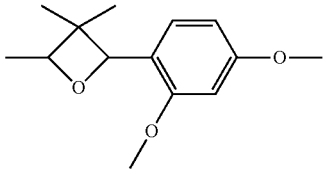

Exemplary Compounds 18

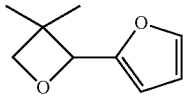

Exemplary Compounds 19

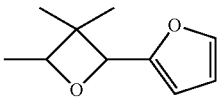

Exemplary Compounds 20

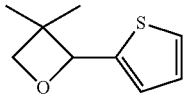

Exemplary Compounds 21

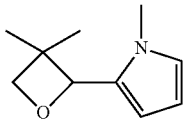

-continued

Exemplary Compounds 22

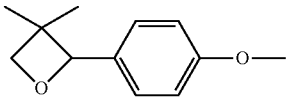

Exemplary Compounds 23

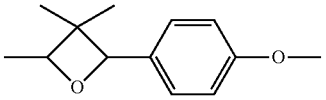

Exemplary Compounds 24

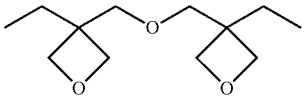

In cationic polymerizable ink utilized in this invention, an epoxy compound can be utilized together with a compound having an oxetane ring at least the 2-position of which is substituted.

As an epoxy compound according to this invention, either monomer of a compound having an epoxy group or oligomer thereof can be utilized. Specifically, listed are an aromatic epoxy compound, an alicyclic epoxy compound and an aliphatic epoxy compound, which are conventionally well known in the art. Hereinafter, an epoxy compound means monomer or oligomer thereof. Oligomer in this invention is preferably a compound having a low molecular weight and oligomer having a molecular weigh of less than 1,000 is more preferable.

A preferable aromatic epoxy compound is di- or poly-glycidyl ether, which is prepared by a reaction of a polyhydric phenol having at least one aromatic nucleus or alkylene oxide adduct thereof, with epichlorohydrin, and for example includes di- or poly-glycidyl ether of bisphenol A or alkylene oxide adduct thereof, di- or poly-glycidyl ether of hydrogenated bisphenol A or alkylene oxide adduct thereof, and novolak type epoxy resin. Herein, alkylene oxide includes such as ethylene oxide and propylene oxide.

An alicyclic epoxy compound is preferably a cyclohexeneoxide or cyclopenteneoxide containing compound, which is prepared by epoxidation of a compound having at least one cycloalkane ring such as a cyclohexene or cyclopentene ring by an appropriate oxidant such as hydrogen peroxide and peracid, and specifically includes compounds described below.

A preferable aliphatic epoxy compound is such as di- or poly-glycidyl ether of aliphatic polyhydric alcohol or alkyleneoxide adduct thereof, and typically includes diglycidyl ether of alkylene glycol such as diglycidyl ether of ethylene glycol, diglycidyl ether of propylene glycol or diglycidyl ether of 1,6-hexanediol; polyglycidyl ether of polyhydric alcohol such as di- or tri-glycidyl ether of glycerin or alkyleneoxide adduct thereof; and diglycidyl ether of polyalkylene glycol such as diglycidyl ether of polyethylene glycol or alkylene oxide adduct thereof and diglycidyl ether of polypropylene glycol or alkylene oxide adduct thereof. Herein alkylene oxide includes such as ethylene oxide and propylene oxide.

Further, in addition to these compounds, monoglycidyl ether of aliphatic higher alcohol as monomer having one oxirane ring in a molecule and monoglycidyl ether of phenol or cresol can be also utilized. Among these epoxy compounds, in consideration of a rapid curing capability, an aromatic epoxy compound and an alicyclic epoxy compound are preferred and an alicyclic epoxy compound is specifically preferred. In this invention, one type of the above-described epoxy compounds alone may be utilized, however, not less than two types may be also utilized in combination.

As aforesaid alicyclic epoxy compound, an alicyclic epoxy compounds represented by following Formula (A), (I) or (II) are preferable.

Formula (A)

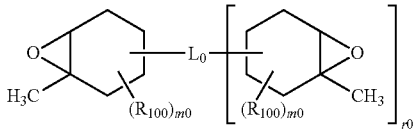

In the Formula (A), $R_{100}$ is a substituent, m0 is 0-2, and r0 is 1-3. $L_0$ is an r0+1 valent connecting group, which may contain an oxygen atom or a sulfur atom in the main chain and has a carbon number of 1-15, or a single bond.

Formula (I)

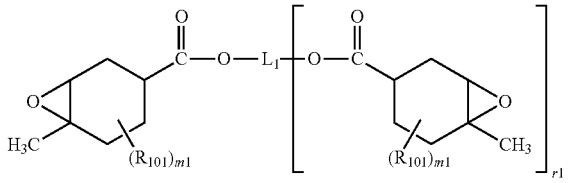

In the formula, $R_{101}$ is a substituent, m1 is 0-2, r1 is 1-3. $L_1$ is an r1+1 valent connecting group, which may contain an oxygen atom or a sulfur atom in the main chain and has a carbon number of 1-15, or a single bond.

Formula (II)

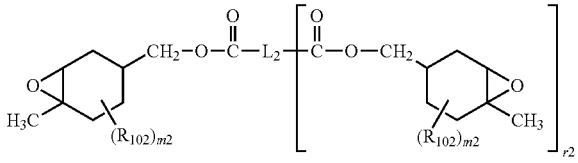

In the formula, $R_{102}$ is a substituent, m2 is 0-2, r2 is 1-3. $L_2$ is an r2+1 valent connecting group, which may contain an oxygen atom or a sulfur atom in the main chain and has a carbon number of 1-15, or a single bond.

In aforesaid Formula (A), (I) or (II), substituents represented by $R_{100}$, $R_{101}$ or $R_{103}$ include a halogen atom (such as a chlorine atom, a bromine atom and a fluorine atom), an alkyl group having a carbon number of 1-6 (such as a methyl group, an ethyl group, a propyl group, an isopropyl group and a butyl group), an alkoxy group having a carbon number of 1-6 (such as a methoxy group, an ethoxy group, a propoxy group, an isopropoxy group, a n-butoxy group and a t-butoxy group), an acyl group (such as an acetyl group, a propionyl group and a trifluoroacetyl group), an acyloxy group (such as an acetoxy group, a propionyloxy group and a trifluoroacetoxy group), and an alkoxycarbonyl group (such as a methoxycarbonyl group, an ethoxycarbonyl group and a t-butoxycarbonyl group). A preferable substituent is an alkyl group, an alkoxy group or an alkoxycarbonyl group.

m0, m1 and m2 are an integer of 0-2, however, are preferably 0 or 1. Further, m0, m1 and m2 may be different from each other in the same molecule.

$L_0$ is an r0+1 valent connecting group, which may contain an oxygen atom or a sulfur atom in the main chain and has a carbon number of 1-15, or a single bond; $L_1$ is an r1+1 valent connecting group, which may contain an oxygen atom or a sulfur atom in the main chain and has a carbon number of 1-15, or a single bond; and $L_2$ is an r2+1 valent connecting group, which may contain an oxygen atom or a sulfur atom in the main chain and has a carbon number of 1-15, or a single bond.

An example of a divalent connecting group, which may contain an oxygen atom or a sulfur atom in the main chain and has a carbon number of 1-15, includes the following groups and groups formed by combining these groups with a plural number of —O— group, —S— group, —CO— group and —CS— group.

Methylene group [$—CH_2—$]

Ethylidene group [$>CHCH_3$]

Isopropylidene group [$>C(CH_3)_2$]

1,2-Ethylene group [$—CH_2CH_2—$]

1,2-Propylene group [$—CH(CH_3)CH_2—$]

1,3-Propanediyl group [$—CH_2CH_2CH_2—$]

2,2-Dimethyl-1,3-propanediyl group [$—CH_2C(CH_3)_2CH_2—$]

2,2-Dimethoxy-1,3-propanediyl group [$—CH_2C(OCH_3)_2CH_2—$]

2,2-Dimethoxymethyl-1,3-propanediyl group [$—CH_2C(CH_2OCH_3)_2CH_2—$]

1-Methyl-1,3-propanediyl group [$—CH(CH_3)CH_2CH_2—$]

1,4-Butanediyl group [$—CH_2CH_2CH_2CH_2—$]

1,5-Pentanediyl group [$—CH_2CH_2CH_2CH_2CH_2—$]

Oxydiethylene group [$—CH_2CH_2OCH_2CH_2—$]

Thiodiethylene group [$—CH_2CH_2SCH_2CH_2—$]

3-Oxthothiodiethylene group [$—CH_2CH_2SOCH_2CH_2—$]

3,3-Dioxthothiodiethylene group [$—CH_2CH_2SO_2CH_2CH_2—$]

1,4-Dimethyl-3-oxa-1,5-pentadiyl group [$—CH(CH_3)CH_2OCH(CH_3)CH_2—$]

3-Oxopentanediyl group [$—CH_2CH_2COCH_2CH_2—$]

1,5-Dioxo-3-oxapentanediyl group [$—COCH_2OCH_2CO—$]

4-Oxa-1,7-heptanediyl group [$—CH_2CH_2CH_2OCH_2CH_2CH_2—$]

3,6-Dioxa-1,8-octanediyl group [$—CH_2CH_2OCH_2CH_2OCH_2CH_2—$]

1,4,7-Trimethyl-3,6-dioxa-1,8-octanediyl group [$—CH(CH_3)CH_2O—CH(CH_3)CH_2OCH(CH_3)CH_2—$]

5,5-Dimethyl-3,7-dioxa-1,9-nonanediyl group [$—CH_2CH_2OCH_2C(CH_3)_2CH_2OCH_2CH_2—$]

5,5-Dimethoxy-3,7-dioxa-1,9-nonanediyl group [$—CH_2CH_2OCH_2C(OCH_3)_2CH_2OCH_2CH_2—$]

5,5-Dimethoxymethyl-3,7-dioxa-1,9-nonanediyl group [$—CH_2CH_2OCH_2C(CH_2OCH_3)_2CH_2OCH_2CH_2—$]

4,7-Dioxo-3,8-dioxa-1,10-decanediyl group [$—CH_2CH_2OCOCH_2CH_2COOCH_2CH_2—$]

3,8-Dioxo-4,7-dioxa-1,10-decanediyl group [$—CH_2CH_2COOCH_2CH_2OCOCH_2CH_2—$]

1,3-Cyclopentanediyl group [$-1,3-C_5H_8—$]

1,2-Cyclohexanediyl group [$-1,2-C_6H_{10}—$]

1,3-Cyclohexanediyl group [$-1,3-C_6H_{10}—$]

1,4-Cyclohexanediyl group [$-1,4-C_6H_{10}—$]

2,5-Tetrahydrofurandiyl group [$2,5-C_4H_6O—$]

p-Phenylene group [$-p-C_6H_4—$]

m-Phenylene group [$-m-C_6H_4—$]

α,α'-o-Xylylene group [$-o-CH_2—C_6H_4—CH_2—$]

α,α'-m-Xylylene group [$-m-CH_2—C_6H_4—CH_2—$]

α,α'-p-Xylylene group [$-p-CH_2—C_6H_4—CH_2—$]

Furan-2,5-diyl-bismethylene group [$2,5-CH_2—C_4H_2O—CH_2—$]

Thiophen-2,5-diyl-bismethylene [$2,5-CH_2—C_4H_2S—CH_2—$]

i-Propylidenbis-p-phenylene [$-p-C_6H_4—C(CH_3)_2-p-C_6H_4—$]

A not less than tri-valent connecting group includes groups which are formed by removing necessary hydrogen atoms at arbitrary positions from the divalent groups listed above, and groups formed by combining them with a plural number of —O— group, —S— group, —CO— group and —CS— group.

$L_0$, $L_1$ and $L_2$ each may be provided with a substituent. Examples of a substituent include a halogen atom (such as a chlorine atom, a bromine atom and a fluorine atom), an alkyl group having a carbon number of 1-6 (such as a methyl group, an ethyl group, a propyl group, an isopropyl group and a butyl group), an alkoxy group having a carbon number of 1-6 (such as a methoxy group, an ethoxy group, a n-propoxy group, an iso-propoxy group, a n-butoxy group and a t-butoxy group), an acyl group (such as an acetyl group, a propionyl group and a trifluoroacetyl group), an acyloxy group (such as an acetoxy group, a propionyloxy group and a trifluoroacetoxy group) and an alkoxycarbonyl group (such as a methoxycarbonyl group, an ethoxycarbonyl group and a t-butoxycarbonyl group). A preferable substituent is an alkyl group, an alkoxy group or an alkoxycarbonyl group. $L_0$, $L_1$ and $L_2$ each are preferably a divalent connecting group which may contain an oxygen atom or a sulfur atom in the main chain and having a carbon number of 1-8, and more preferable is a divalent connecting group the main chain of which is comprised of only carbon atoms and having a carbon number of 1-5.

In this invention, a more preferable alicyclic epoxy compound is a compound represented by either of following Formula (III) or (IV) is preferred.

Formula (III)

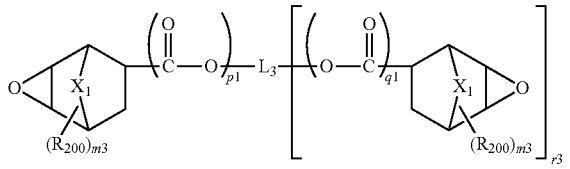

In the formula, $R_{200}$ is an aliphatic group at positions except α and β positions of an oxirane ring, and m3 is 0-2. $X_1$ is $—(CH_2)_{n0}—$ or $—(O)_{n0}—$, and n0 is 0 or 1. p1 and q1 each are 0 or 1 and are never simultaneously 0. r3 is 1-3. $L_3$ is an r3+1 valent connecting group provided with a branched structure, which may contain an oxygen atom or a sulfur atom in the main chain and has a carbon number of 1-15, or a single bond.

Formula (IV)

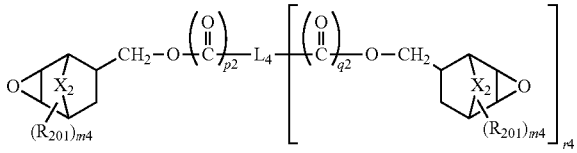

In the formula, $R_{201}$ is an aliphatic group at positions except α and β positions of an oxirane ring, and m4 is 0-2. $X_2$ is —$(CH_2)_{n1}$— or —$(O)_{n1}$—, and n1 is 0 or 1. p2 and q2 each are 0 or 1 and are never simultaneously 0. r4 is 1-3. $L_4$ is an r4+1 valent connecting group provided with a branched structure, which may contain an oxygen atom or a sulfur atom in the main chain and has a carbon number of 1-15, or a single bond.

In above Formulas (III) and (IV), $R_{200}$ and $R_{201}$ are an aliphatic group. The aliphatic group includes an alkyl group having a carbon number of 1-6 (such as a methyl group, an ethyl group, a propyl group, an isopropyl group and a butyl group), a cycloalkyl group having a carbon number of 3-6 (such as a cyclopropyl group, a cyclobutyl group, a cyclopentyl group and a cyclohexyl group), an alkenyl group having a carbon number of 1-6 (such as a vinyl group, a 1-propenyl group, a 2-propenyl group and a 2-butenyl group), an alkynyl group having a carbon number of 1-6 (such as an acetylenyl group, a 1-propynyl group, a 2-propynyl group and a 2-butynyl group). Preferable is an alkyl group having a carbon number of 1-3, and more preferable are a methyl group and an ethyl group.

m3 and m4 are 0-2, however, preferably not less than 1.

$X_1$ is —$(CH_2)_{n0}$— or —$(O)_{n0}$—, and $X_2$ is —$(CH_2)_{n1}$— or —$(O)_{n1}$—. n0 and n1 is 0 or 1, and $X_1$ and $X_2$ are not present when n0 and n1 are 0.

m3+n0 or m4+n1 is preferably not less than 1.

$L_3$ is an r3+1 valent connecting group provided with a branched structure, which may contain an oxygen atom or a sulfur atom in the main chain and has a carbon number of 1-15, or a single bond; $L_4$ is an r4+1 valent connecting group provided with a branched structure, which may contain an oxygen atom or a sulfur atom in the main chain and has a carbon number of 1-15, or a single bond. A divalent connecting group, which may contain an oxygen atom or a sulfur atom in the main chain and has a carbon number of 1-15, includes the following groups and groups formed by combining said groups with a plural number of —O— group, —S— group, —CO— group and —CS— group.

Ethylidene group [$>CHCH_3$]

Isopropylidene group [$>C(CH_3)_2$]

2,2-Dimethyl-1,3-propanediyl group [—$CH_2C(CH_3)_2CH_2$—]

2,2-Dimethoxy-1,3-propanediyl group [—$CH_2C(OCH_3)_2CH_2$—]

2,2-Dimethoxymethyl-1,3-propanediyl group [—$CH_2C(CH_2OCH_3)_2CH_2$—]

1-Methyl-1,3-propanediyl group [—$CH(CH_3)CH_2CH_2$—]

1,4-Dimethyl-3-oxa-1,5-pentadiyl group [—$CH(CH_3)CH_2OCH(CH_3)CH_2$—]

1,4,7-Trimethyl-3,6-dioxa-1,8-octanediyl group [—$CH(CH_3)CH_2OCH(CH_3)CH_2OCH(CH_3)CH_2$—]

5,5-Dimethyl-3,7-dioxa-1,9-nonanediyl group [—$CH_2CH_2OCH_2C(CH_3)_2CH_2OCH_2CH_2$—]

5,5-Dimethoxy-3,7-dioxa-1,9-nonanediyl group [—$CH_2CH_2OCH_2C(OCH_3)_2CH_2OCH_2CH_2$—]

5,5-Dimethoxymethyl-3,7-dioxa-1,9-nonanediyl group [—$CH_2CH_2OCH_2C(CH_2OCH_3)_2CH_2OCH_2CH_2$—]

Isopropylidenbis-p-phenylene group [-p-$C_6H_4$—$C(CH_3)_2$-p-$C_6H_4$—]

A connecting group of not less than trivalent includes a group, which is formed by removing a necessary number of hydrogen atoms at arbitrary portions from a divalent connecting group descried above, and a group comprising a combination thereof with a group, which is formed combining a plural number of —O— group, —S— group, —CO— group and —CS— group.

$L_3$ and $L_4$ may be provided with a substituent. Examples of the substituent include a halogen atom (such as a chlorine atom, a bromine atom and a fluorine atom), an alkyl group having a carbon number of 1-6 (such as a methyl group, an ethyl group, a propyl group, an isopropyl group and a butyl group), an alkoxy group having a carbon number of 1-6 (such as a methoxy group, an ethoxy group, a n-propoxy group, an iso-propoxy group, a n-butoxy group and a t-butoxy group), an acyl group (such as an acetyl group, a propionyl group and a trifluoroacetyl group), an acyloxy group (such as an acetoxy group, a propionyloxy group and a trifluoroacetoxy group) and an alkoxycarbonyl group (such as a methoxycarbonyl group, an ethoxycarbonyl group and a t-butoxycarbonyl group). A preferable substituent is a halogen atom, an alkyl group and an alkoxy group.

In the following, exemplary compounds of Formulas (A), (I), (II), (III) and (IV) will be shown.

EP-1

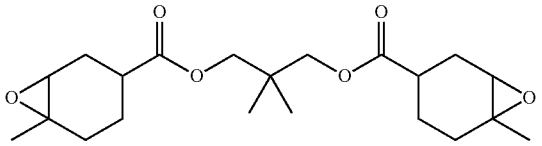

molecular weight 380.48

EP-2

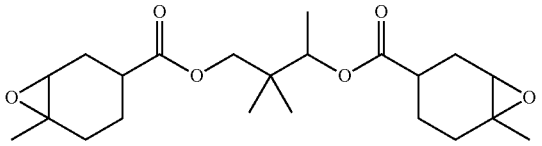

molecular weight 366.45

EP-3

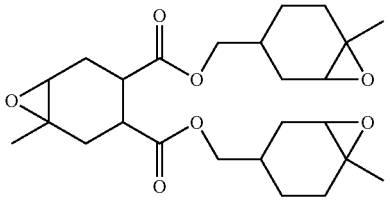

molecular weight 434.52

EP-4

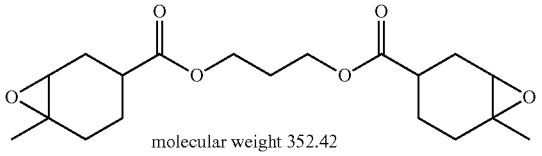

molecular weight 352.42

EP-5

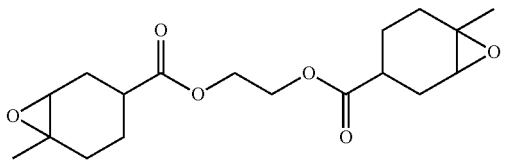

molecular weight 338.40

-continued
EP-6
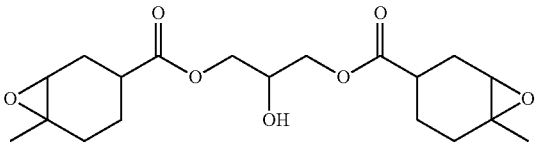
molecular weight 380.48
EP-7
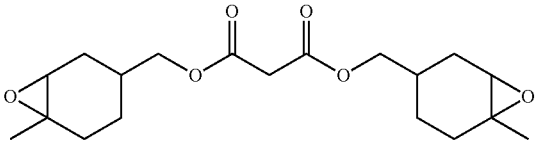
molecular weight 352.42
EP-8
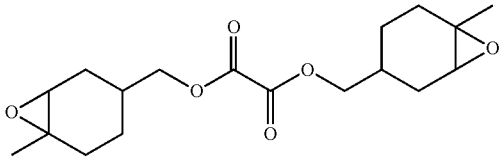
molecular weight 338.40
EP-9
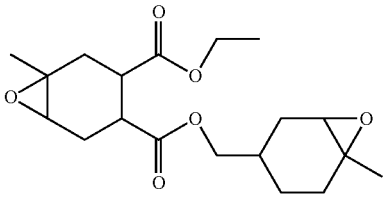
molecular weight 352.42
EP-10
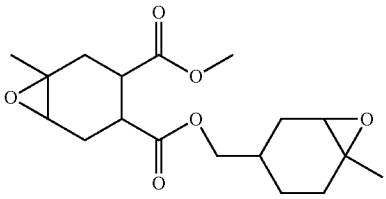
molecular weight 338.4
EP-11
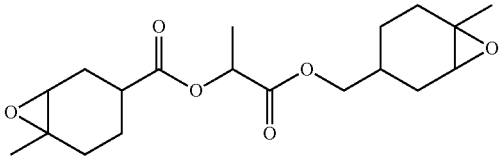
molecular weight 352.42
EP-12
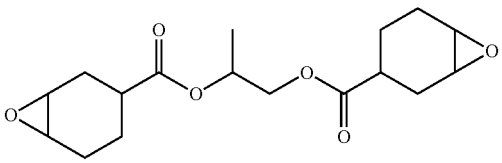
-continued
EP-13
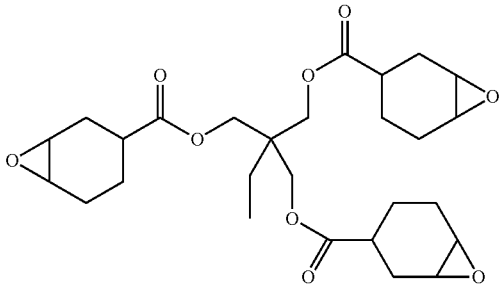
EP-14
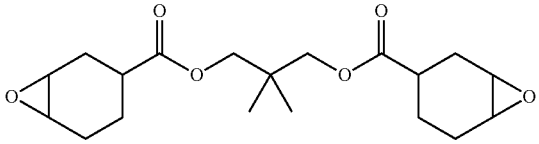
EP-15
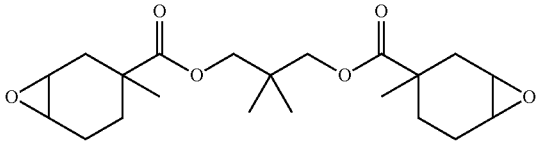
EP-16
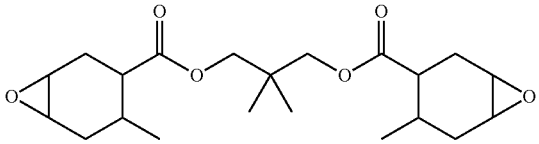
EP-17
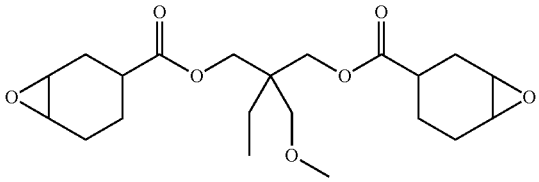
EP-18
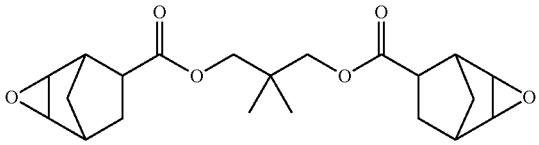
EP-19
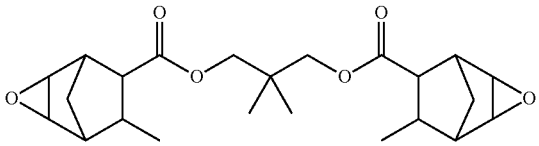
EP-20
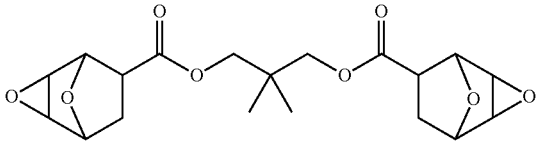
The added amount of an alicyclic epoxy compound is preferably 10-80 weight % in the total ink. In the case of less than 10 weight %, the curing capability is badly varied depending on curing environment (temperature, humidity) to make the composition unusable. In the case of over 80 weight %, film physical properties become weak to make the composition unusable. In this invention, one type of an alicyclic epoxy compound may be utilized alone; however, not less than two types may be also utilized in appropriate combination.

Further, these alicyclic epoxy compounds, although the manufacturing method is not specifically limited, can be synthesized referring to, for example, the forth edition, Experimental Chemistry Course 20, Organic Synthesis II, p. 213-, published by Maruzen KK Shuppan (1992); "The Chemistry of Heterocyclic Compounds-Small Ring Heterocycles part 3, Oxiranes", edited by Alfred Hasfner, John & Willey and Sons, An Interscience Publication, New York (1985); Yoshimura, Adhesion vol. 29, No. 12, 32 (1985), Yoshimura, Adhesion vol. 30, No. 5, 42 (1986), Yoshimura, Adhesion vol. 30, No. 7, 42 (1986), JP-A 11-100378, Japanese Patent Nos. 2,906,245 and 2,926,262.

In photo-curable ink according to this invention, it is also preferable to incorporate epoxydated fatty acid ester or epoxidated fatty acid glyceride as an epoxy compound.

To incorporate epoxydated fatty acid ester or epoxidated fatty acid glyceride in combination with a system of oxetane compound/alicyclic epoxy compound, is preferable with respect to safety-environment such as AMES and sensitizing, skin irritation and odor, as well as can solve conventional problems such as generation of wrinkles due to curing shrinkage and poor curing capability and poor ejection behavior, which depend on curing environment (temperature, humidity).

As utilizable epoxidated fatty acid ester and epoxidated fatty acid glyceride, fatty acid ester and fatty acid glyceride, in which an epoxy group is introduced, can be employed without specific limitation.

Epoxidated fatty acid ester is those manufactured by epoxidation of oleic acid ester, and such as methyl epoxystearate, butyl epoxystearate and octyl epoxystearate are utilized. Further, epoxidated fatty acid glyceride is those manufactured by epoxidation of such as soybean oil, linseed oil and castor oil, and such as epoxidated soybean oil, epoxidated linseed oil and epoxidated castor oil are utilized.

The added amount of these epoxy compounds is preferably not less than 30 weight % based on the total ink weight.

As a photo-polymerization initiator utilized in cationic polymerizable ink, a photo-induced acid generator, which generates acid by ultraviolet irradiation, is preferably utilized.

As a photo-induced acid generator utilized in cationic polymerizable ink, a compound utilized in chemical amplification type photoresist and photo-cationic polymerization is employed (refer to "Organic Materials for Imaging", pp. 187-192, Bunshin Shuppan (1993)). Compounds preferably utilized in this invention are listed bellow.

Firstly, listed are salt of $B(C_6F_5)_4^-$, $PF_6^-$, $AsF_6^-$ and $SbF_6^-$; and sulfonate such as p-$CH_3C_6H_4SO_3^-$ and p-$CF_3SO_3^-$; of aromatic onium compounds such as diazonium, ammonium, iodonium, sulfonium and phosphonium.

Secondly, listed are sulfonated compounds which generate sulfonic acid.

Thirdly, halogenides which generate hydrogen halogenide can be also utilized.

Fourthly, listed are iron allene complexes.

A cationic photo-polymerization initiator preferably utilized in this invention includes a photo-induced acid generator such as aryl sulfonium salt derivatives (such as Silacure UVI-6990 and Silacure UVI-6974 manufactured by Union Carbide Corp.; Adekaoptomer SP-150, Adekaoptomer SP-152, Adekaoptomer SP-170 and Adekaoptomer SP-172 manufactured by Asahi Denka Co., Ltd.), allyl iodonium salt derivatives (such as RP-2074, manufactured by Rohdia Corp.), allene-ion complex derivatives (such as Irgacure 261, manufactured by Ciba Geigy Corp.), diazonium salt derivatives, triazine type initiators and other halogenides. A cationic photo-polymerization initiator is preferably incorporated at a ratio of 0.2-20 weight parts against 100 weight parts of a compound having cationic polymerizing capability. It is difficult to prepare a cured product when the content of photo-polymerization initiator is less than 0.2 weight parts, while there is no further improving effect of curing when the amount is over 20 weight parts. These photo-cationic polymerization initiators may be utilized by selecting one type or not less than two types.

In cationic polymerizable ink, as a photo-induced acid generator to be a polymerization initiator, those not to generate benzene by actinic ray irradiation are preferable, and onium salt such as iodonium salt and sulfonium salt is preferable. Specifically, it indicates that an amount of benzene, which is generated when an image having approximately 100 $m^2$ with a thickness of 15 μm is printed by use of ink containing 5 weight % of onium salt (a photo-induced acid generator) in the ink composition and actinic rays as much as sufficiently decompose the photo-induced acid generator in a state of keeping the ink film surface at 30° C. are irradiated, is extremely small as not more than 5 μg or none. As said onium salt, sulfonium salt or iodonium salt is preferable, and those having a substituent on a benzene ring, which bonds to $S^+$ or $I^+$, satisfy the above conditions. The sulfonium salt is preferably a sulfonium salt compound represented by aforesaid Formulas 1-4. Those having a substituent on a benzene ring which bonds to $S^+$ of sulfonium salt satisfy the above conditions.

Formula 1

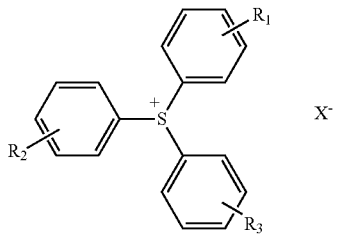

Formula 2

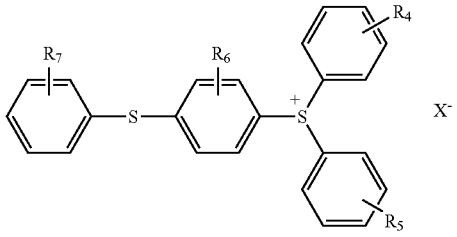

-continued

Formula 3

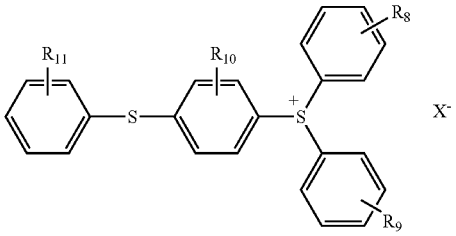

Formula 4

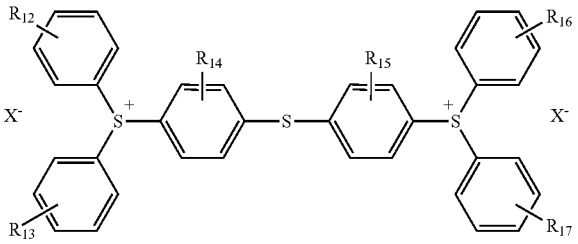

In aforesaid Formulas 1-4, $R_1$-$R_{17}$ each are a hydrogen atom or a substituent. However, $R_1$-$R_3$ are never a hydrogen atom at the same time; $R_4$-$R_7$ are never a hydrogen atom at the same time; $R_8$-$R_{11}$ are never a hydrogen atom at the same time; and $R_{12}$-$R_{17}$ are never a hydrogen atom at the same time.

A substituent represented by $R_1$-$R_{17}$ includes an alkyl group such as a methyl group, an ethyl group, a propyl group, a butyl group, an isobutyl group, a t-butyl group, a pentyl group and a hexyl group; an alkoxy group such as a methoxy group, an ethoxy group, a propoxy group, a butoxy group, a hexyloxy group, a decyloxy group and a dodecyloxy group; a carbonyl group such as an acetoxy group, a propionyloxy group, a decylcarbonyloxy group, a dodecylcarbonyloxy group, a methoxycarbonyl group, an ethoxycarbonyl group and a benzoyloxy group; a phenylthio group; a halogen atom such as a fluorine atom, a chlorine atom, a bromine atom and an iodine atom; a cyano group; a nitro group and a hydroxyl group.

X is a non-nucleophilic anionic residual group, and includes a halogen atom such as F, Cl, Br and I; $B(C_6F_5)_4$, $R_{18}COO$, $R_{18}SO_3$, $SbF_6$, $AsF_6$, $PF_6$ and $BF_4$. However, $R_{18}$ and $R_{19}$ each are an alkyl group such as a methyl group, an ethyl group, a propyl group and a butyl group; a halogen atom such as a fluorine atom, a chlorine atom, a bromine atom and an iodine atom; a nitro group, a cyano group, an alkyl group or a phenyl group, which may be substituted by an alkoxy group such as a methoxy group and an ethoxy group. Among them, preferable are $B(C_6F_5)_4$ and $PF_6$ with respect to safety.

The above-described compounds can be easily synthesized by a method well known in the art similarly to photo-induced acid generators described in The Chemical Society of Japan Vol. 1, No. 11 (1998) and "Organic Materials for Imaging", Bunshin Shuppan (1993).

In this invention, sulfonium salt represented by Formulas 1-4 is specifically preferably at least one type of sulfonium salt selected from following Formulas 5-13. X is a non-nucleophilic anionic residual group, similar to those described before.

Further, a sulfonium salt selected from aforesaid Formulas 1-4 is preferably at least one type selected from following Formulas 5-13.

Formula 5

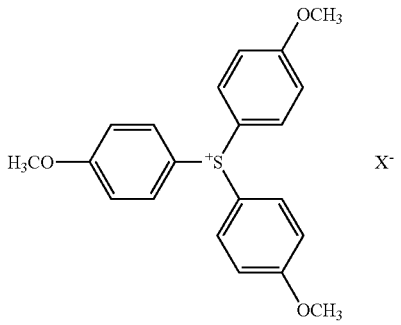

Formula 6

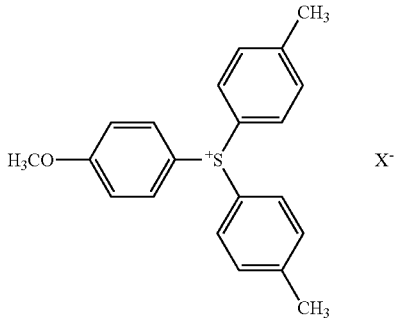

Formula 7

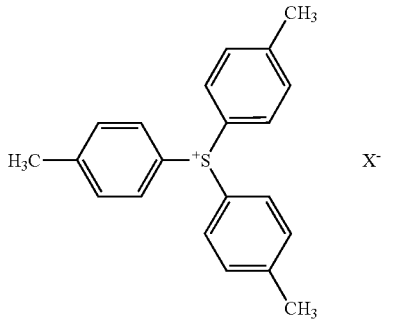

Formula 8

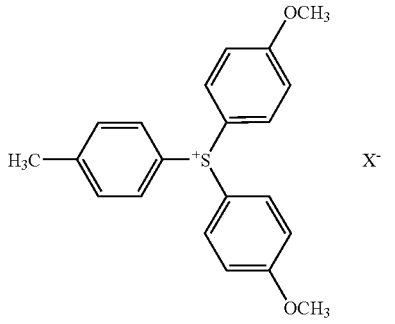

Formula 9

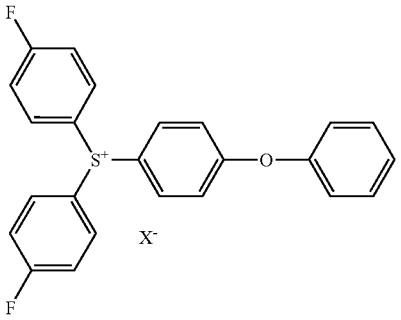

-continued
Formula 10
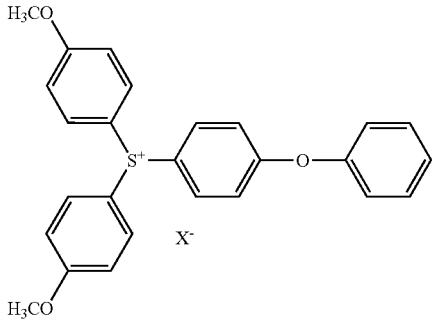
In the formula, X− is non-nucleophilic anionic residual group.
Formula 11
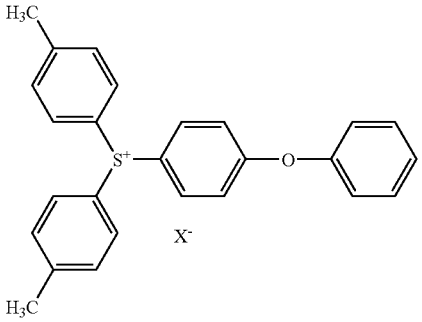
Formulla 12
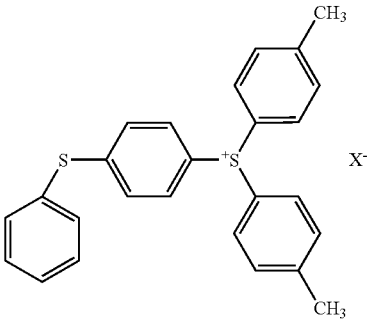
Formula 13
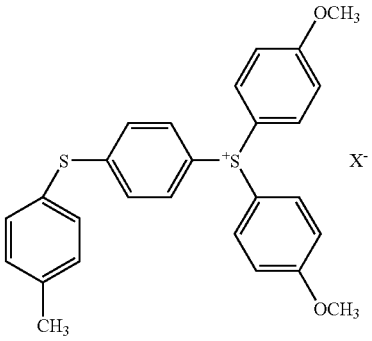
In the formula, X− is non-nucleophilic anionic residual group.
Exemplary compounds including iodonium salt include the following compounds in addition to aforesaid Formulas 5-13 wherein X is $PF_6$.
S-1
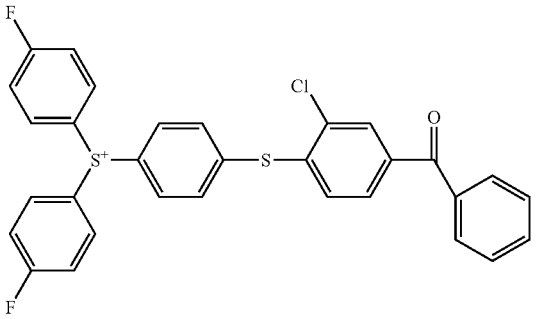
S-2
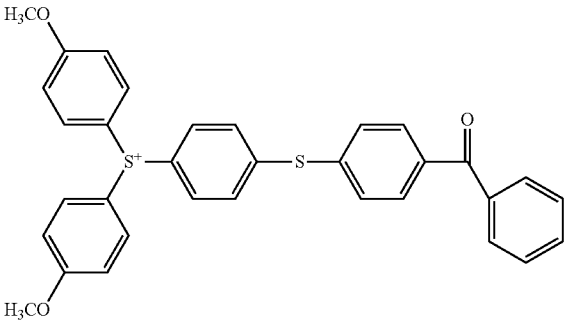
S-3
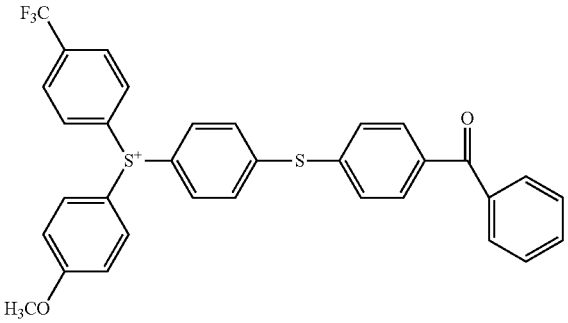
S-4
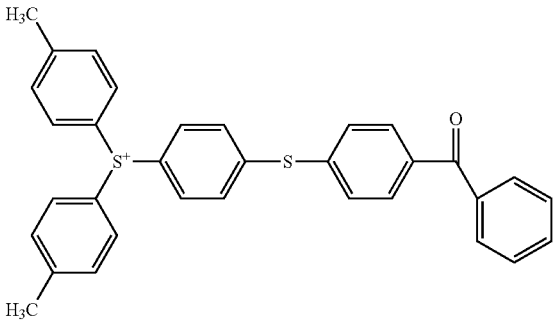

-continued
S-5
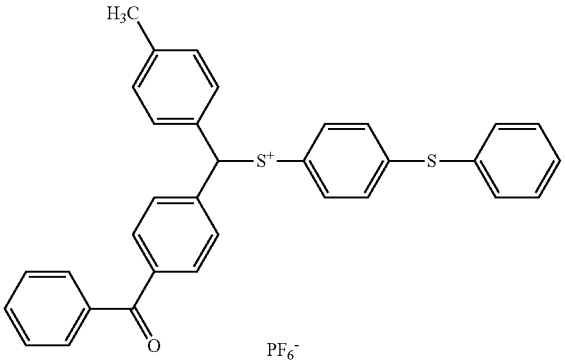
S-6
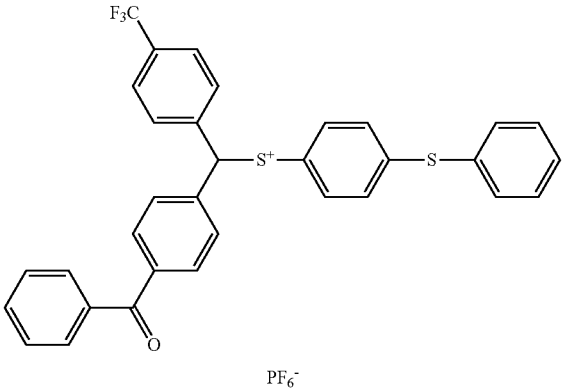
S-7
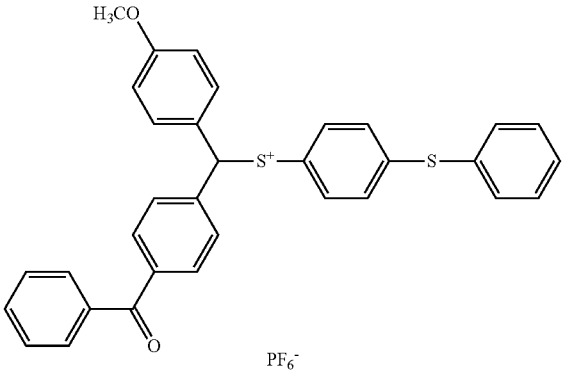
S-8
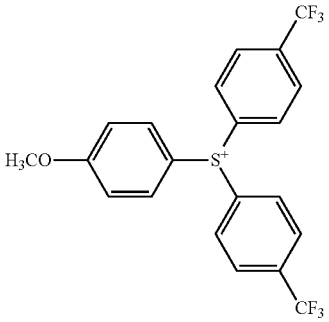
-continued
S-9
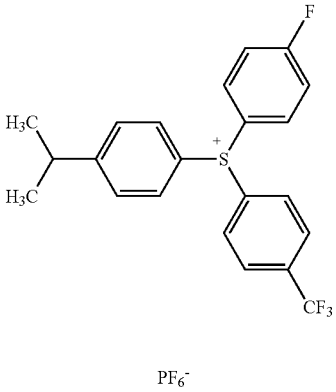
S-10
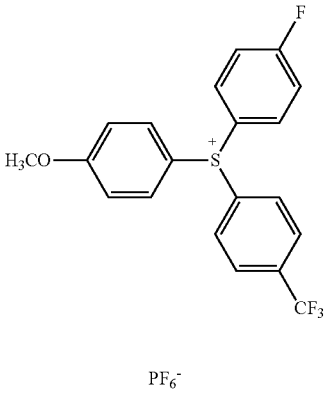
I-1
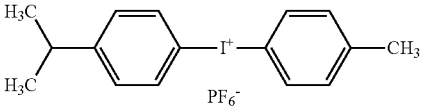
I-2
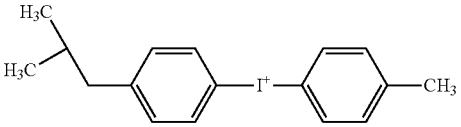
I-3
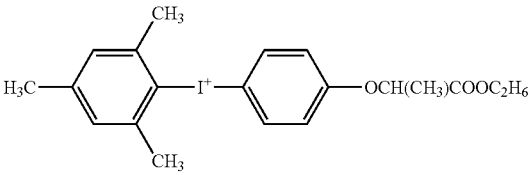
I-4
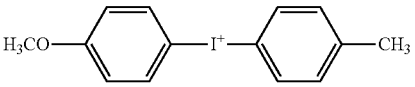

-continued

I-5

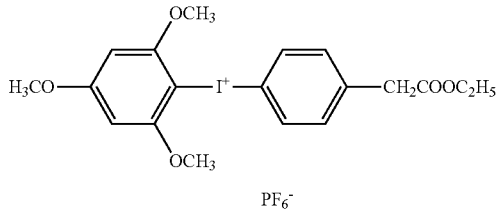

Particularly, in the invention according to Items (17)-(23), uncured ink quantity on a substrate at the time of ultraviolet irradiation is necessarily to be limited to the quantity to make ultraviolet transmittance at the absorption peak wavelength of a photo-polymerization initiator of not less than 0.1%. Since a photo-polymerization initiator is required to polymerize a polymerizing compound by absorbing ultraviolet rays, the upper limit of ultraviolet transmittance is less than 100%. An ultraviolet light source is required to be provided with spectrum at this absorption peak wavelength.

(Colorant)

Since a colorant is a primary component of ultraviolet ray absorption in ultraviolet curable ink, particularly in the invention according to Items (17)-(23), the selection of said colorant is important to decrease ink application quantity while keeping a required image density. As a colorant of ultraviolet curable ink utilized in this invention, a colorant capable of being dissolved or dispersed in the primary component of a photo-polymerizable compound can be utilized, however, pigment is preferred with respect to a weather-proofing.

Actinic ray curable ink-jet ink of this invention contains pigment as a colorant. Preferably utilized pigment will be listed below.

C. I. Pigment Yellow-1,3, 12, 13, 14, 17, 42, 74, 81, 83, 87, 93, 95, 109, 120, 128, 138, 139, 151, 166, 180, and 185

C. I. Pigment Orange-16, 36, and 38

C. I. Pigment Red-5, 22, 38, 48:1, 48:2, 48:4, 49:1, 53:1, 57:1, 63:1, 101, 122, 144, 146, 177, and 185

C. I. Pigment Violet-19, and 23

C. I. Pigment Blue-15:1, 15:3, 15:4, 18, 60, 27, and 29

C. I. Pigment Green-7, and 36

C. I. Pigment White-6, 18, and 21

C. I. Pigment Black-7

For the purpose of dispersion of the above pigment, such as a ball mill, a sand mill, an atliter, a roll mill, an agitator, a Henschel mixer, a colloidal mill, an ultrasonic homogenizer, a pearl mill, a wet jet mill and a paint shaker can be utilized. A dispersion medium is preferably a photo-polymerizable compound, and monomer having the lowest viscosity among them is more preferably selected with respect to dispersion adaptability.

For dispersion of pigment, it is preferable to make the particle size of pigment particles of 0.08-0.5 μm, and selection of pigment, a dispersant and a dispersion medium; dispersion condition, and filtration condition are appropriately set so as to make the maximum particle size of 0.3-10 μm and preferably of 0.3-3 μm. By this particle size control, clogging of a head nozzle is depressed and storage stability, transparency and curing sensitivity of ink can be maintained.

In actinic ray curable ink-jet ink of this invention, the colorant concentration is preferably 1-10 weight % based on the total ink.

Each ink is prepared employing these pigment as a colorant, in the invention according to Items (17)-(23), particularly ink of R, G and B, which are secondary colors among ink of 7 colors, may utilize pigment having the color itself. Further, a dye component of R ink may be a combination of a dye component of Y ink and a dye component of M ink; a dye component of B ink may be a combination of a dye component of M ink and a dye component of C ink; and a dye component of G ink may be a combination of a dye component of C ink and a dye component of Y ink. As a pigment dispersant, a polymer dispersant is preferably utilized.

Further, as a pigment dispersant, those having a basic anchor portion are preferably utilized, and a polymer dispersant having a comb form structure is more preferably utilized.

A polymer dispersant includes Solsperse Series by Avecia Corp. Specific examples of an utilizable pigment dispersant in this invention include such as Solsperse 9000, 17000, 18000, 19000, 20000, 24000SC, 24000GR, 28000 and 32000, manufactured by Avecia Corp.; Ajisper PB821, and PB822, manufactured by Ajinomoto Fine Techno Co., Ltd.; PLAAD ED214, ED251, DISPARLON DA-325 and DA-234, manufactured by Kusumoto Chemicals Co., Ltd.; EFKA-5207, 5244, 6220 and 6225, manufactured by EFKA Corp. Further, in addition to a pigment dispersant, a pigment derivative (a synergist) may be incorporated; and specific examples of a pigment derivative include such as Solsperse 5000, 12000 and 22000, manufactured by Avecia Corp.; and EFKA-6746 and 6750, manufactured by EFKA Corp. These dispersants and dispersion aids are preferably incorporated at 1-50 weight parts against 100 weight parts of pigment. As a dispersion medium, a solvent or a polymerizing compound is utilized, however, ultraviolet curable ink utilized in this invention, since being reacted-cured immediately after ink deposition, is preferably contains no solvent. When a solvent remains in a cured image, there are caused problems of deterioration of solvent resistance and VOC of a remaining solvent. Therefore, not a solvent but a polymerizing compound, and among them, a polymerizing compound having the lowest viscosity is preferably selected as a dispersion medium, with respect to dispersion adaptability.

Photo-curable ink of this invention preferably incorporates an aliphatic cyclic ester compound of 4-10 member ring or a cyclic ether compound of not less than 5 member ring, to improve curing capability and adhesiveness with various substrates.

A cyclic ester compound is preferably an aliphatic cyclic ester compound of 4-10 member ring. Specifically, listed are such as ε-caprolactone-6-hydroxyhexanoic acid-1,6-lactone, β-propiolactone, β-butylolactone, α-methyl-β-butylolactone, γ-butylolactone, γ-valerolactone, δ-valerolactone, ε-caprolactone, γ-caprolactone, γ-heptanolactone, cumarine, tetronic acid, pyrone, phthalide, 3-methyl-1,4-dioxa-2,5-dione, p-dioxane, molpholinedione, and morpholinedione and molphline. Further, mixture of these compounds may be also utilized.

A cyclic ether compound is preferably a cyclic ether compound of not less than 5 member ring and more preferably a cyclic ether compound containing no carbonic ester structure. Specifically, listed are 1,3-dioxorane, tetrahydrofuran, 1,4-dioxane, 1,3,5-trioxane, crown ether (such as 12-crown-4), 1,2-dimethyltetrahydrofuran, 2-methyltetrahydrofuran, 2-methyldioxorane and 4-methyldioxorane.

The content of an aliphatic cyclic ester compound of 4-10 member ring and a cyclic ether compound of not less than 5 member ring is preferably 1-10 weight %.

In an actinic ray curable composition of this invention, various additives other than those described above can be utilized. For example, incorporated can be a surfactant, a leveling additive and a matting agent; polyester type resin, polyurethane type resin, vinyl type resin acrylic resin, rubber type resin and waxes to control film physical properties. Further, any basic compound well known in the art can be utilized to improve storage stability; however, typically listed are a basic alkali metal compound, a basic alkaline earth metal compound and basic organic compound such as amine. Further, hybrid of radical-cation type curing ink is also utilized.

A basic compound can be also incorporated. By incorporation of a basic compound, ejection stability is improved as well as generation of wrinkles due to curing shrinkage can be inhibited even under low humidity. Any basic compound well known in the art can be utilized, however, typically listed is such as a b asic alkali metal compound, a basic alkaline earth metal compound and a basic organic compound such as amine.

The basic alkali metal compound described before includes hydroxide of alkali metal (such as lithium hydroxide, sodium hydroxide and potassium hydroxide), carbonate of alkali metal (such as lithium carbonate, sodium carbonate and potassium carbonate) and alcoholate of alkali metal (such as sodium methoxide, sodium ethoxide, potassium methoxide and potassium ethoxide). The aforesaid basic alkaline earth metal compound includes hydroxide of alkaline earth metal (such as magnesium hydroxide and calcium hydroxide), carbonate of alkaline earth metal (such as magnesium carbonate and calcium carbonate) and alcoholate of alkaline earth metal (such as magnesium methoxide).

A basic organic compound includes nitrogen containing heterocyclic compounds such as amine, quinoline and quinolidine, however, amine is preferred with respect to compatibility with photo-polymerizing monomer, which includes such as octylamine, naphthylamine, xylenediamine, benzylamine, diphenylamine, dibutylamine, dioctylamine, dimethylaniline, quinucridine, tributylamine, trioctylamine, tetramethylethylenediamine, tetramethyl-1,6-hexamethylenediamine, hexatetramine and triethanolamine.

The concentration of a basic compound incorporated is in a range of preferably 10-1,000 weight ppm and specifically preferably of 20-500 weight ppm, based on the total photo-polymerizing monomer. Herein, a basic compound may be utilized alone or in combination of plural types.

In actinic ray curable ink-jet ink of this invention, an actinic ray curable composition preferably has a viscosity at 25° C. of 7-40 mPa·s with respect to achieving stable ejection behavior and an excellent curing capability regardless of curing environment (such as temperature and humidity).

(Substrate)

As a substrate utilized as a recording material in this invention, any of a wide range of synthetic resin utilized in various applications heretofore can be employed, and specifically listed are such as polyester, polyvinyl chloride, polyethylene, polyurethane, polypropylene, acrylic resin, polycarbonate, polystyrene, acrylonitrile-butadiene-styrene copolymer, polyethylene terephthalate and polybutadiene terephthalate, and the thickness and form of these synthetic resin substrate are never limited.

As a substrate utilized in this invention, a non-absorptive support in addition to ordinary non-coated paper and coated paper, however, among them preferably utilized is a non-absorptive support as a substrate.

As a non-absorptive support, various types of plastic and film thereof can be utilized, and various plastic film includes such as PET film, OPS film, OPP film, ONy film, PVC film, PE film and TAC film. In addition to these, such as polycarbonate, acrylic resin, ABS, polyacetal, PVA and rubbers can be utilized. Further, metals and glasses are also applicable. Among these substrates, a constitution of this invention is effective in the case of forming an image on PET film, OPS film, OPP film, ONy film and PVC film, which are capable of shrinkage by heat. In these substrates, curl and deformation of film are easily caused by such as curing shrinkage of ink and heat at the time of a curing reaction, and ink film is difficult to follow shrinkage of a substrate.

The surface energy of these various types of plastic film significantly differs and there has been a problem heretofore that the dot diameter will change after deposition depending on a substrate. A constitution of this invention includes from OPP film and OPS film having a small surface energy till PET film having a relatively large surface energy, however, a substrate is preferably provided with a wet index of 40-60 mN/m, with respect to adhesiveness and bleeding.

In this invention, a long length (a web) recording material is advantageously utilized, with respect to a cost of a recording material such as packaging expense and a manufacturing cost, preparation efficiency of print and adaptability to various sizes of print.

Next, an image forming method and an ink-jet recording device according to the invention described in Items (1)-(16) will be explained.

In an image forming method of this invention, the above-described ink is ejected and drawn on a recording material by means of an ink-jet recording method and successively the ink is cured by irradiation of actinic rays such as ultraviolet rays.

(Total Ink Layer Thickness after Ink Deposition)

In the invention described in Items (1)-(16), ink quantity cured at a time by actinic ray irradiation after ink has deposited on a recording material is not less than 5 g/m$^2$, and preferably not less than 10 g/m$^2$ and not more than 20 g/m$^2$ while the total ink layer thickness after having been cured is preferably 2-25 μm. In actinic ray curable ink-jet recording of a screen printing application, the total ink layer thickness is over 25 μm in the present state, however, in a soft package printing application, in which a recording material is usually a thin plastic material, ink ejection of an excessive layer thickness is not preferable because there is a problem that stiffness and sensation in quality of the total printed matter will be changed.

Herein, "the total ink layer thickness" means the maximum value of an ink layer thickness drawn on a recording material, and means the same with any case of recording by an ink-jet method of single-color, two-color accumulation (secondary color), three-color accumulation or four-color accumulation (white ink base).

(Ejection Condition of Ink)

It is preferable to maintain the temperature constant while raising ink temperature with respect to ejection stability because photo-curable ink has a large viscosity variation width due to temperature variation and viscosity variation directly influences a liquid drop size and a liquid drop ejection rate to cause image deterioration. As an ink ejection condition, it is preferable to heat a recording head and ink at 35-100° C. The control range of ink temperature is a set temperature ±5° C., preferably a set temperature ±2° C., and more preferably a set temperature ±1° C.

Herein, in this invention, recording material P is also preferably heated at 35-60° C.

Ink of this invention preferably has a viscosity at 25° C. in a range of 15-500 mPa·s to be appropriately leveled on a substrate after ink deposition and to obtain adhesion, however, is preferably subjected to temperature control by heating as described before so as to make an ink viscosity at the time of ink ejection of 6-20 mPa·s with respect to obtaining stability of ink ejection in ink-jet recording. These viscosities can be measured by use of a rotation viscometer (Model DV-II+, manufactured by Brookfield Corp.).

Further, surface tension of ink at the time of ejection is preferably in a range of 22-38 mN/m, and more preferably in a range of 24-35 mN/m. Further, in the invention according to Items (1)-(16), liquid drop quantity ejected from each nozzle is preferably 2-15 pl.

Figure 2:
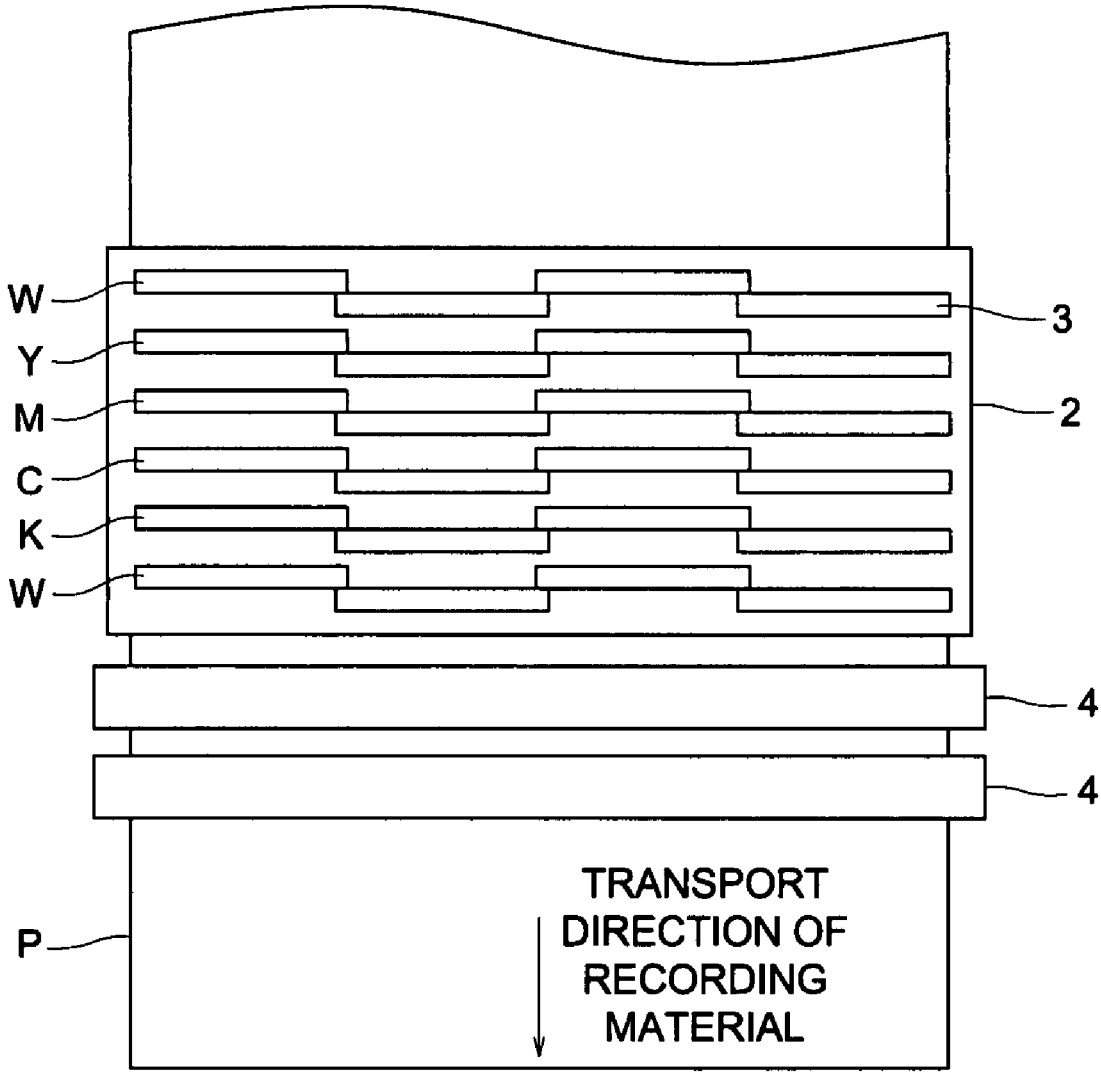
FIG. 2 is an over view showing another example of a constitution of the primary portion of an ink-jet recording device of this invention.

Next, an ink-jet recording device (hereinafter, simply referred to as a recorder) of the invention according to Items (1)-(16) will be explained appropriately referring to the drawing (FIG. 1 or 2).

Herein, a recorder of the drawing is only an embodiment of a recorder of the invention according to Items (1)-(16), and this invention is not limited to the drawing.

FIG. 1 is a front view to show a constitution of the primary portion of a recorder according to the invention described in Items (1)-(16). Recorder 1 is constituted of such as head carriage 2, recording head 3, irradiation means 4 and platen portion 5. In this recorder 1, platen portion 5 is arranged under recording material P. Platen portion 5 is provided with a function to absorb ultraviolet rays and absorbs excess ultraviolet rays having passed through recording material P. As a result, an image having a high precision can be very stably reproduced.

Recording material P is guided by guide member 6 to be transferred from this side to the interior of FIG. 1 by operation of a transfer means (not shown in the drawing). A head scanning means (not shown in the drawing) scans recording head 3 held by head carriage 2 by shifting head carriage 2 back and forth along the Y direction in FIG. 1.

Head carriage 2 is arranged over recording material P to store a plural number of recording head 3, which will be described later, corresponding to the number of colors utilized for image printing on recording material P while arranging the ejection outlet downward. Head carriage 2 is arranged in a form of freely shiftable back and forth against the main body of recorder 1, and is shifted back and forth along the Y direction of FIG. 1 by drive of a head scanning means.

Herein, in FIG. 1, head carriage 2 is drawn so as to store recording head 3 of yellow (Y), magenta (M), cyan (C), black (K), light yellow (Ly), light magenta (Lm), light cyan (Lc), light black (Lk) and white (W), however, in practical use, a number of colors of recording head 3 to be stored in head carriage 2 can be appropriately determined.

Recording head 3 ejects actinic ray curable ink-jet ink (for example, UV curable ink), which has been supplied from an ink supply means (not shown in the drawing) toward recording material P through an ejection outlet by operation of an ejection means (not shown in the drawing), a plural number of which are stored in the recording head. UV ink ejected from recording head 3 is comprised of such as a colorant, polymerizing monomer and a polymerization initiator, and provided with a capability of curing by cross-linking or a polymerization reaction of the monomer accompanied with catalytic action of the initiator by receiving irradiation of ultraviolet rays.

Recording head 3 ejects UV curable ink as ink drops on a predetermined region (a region capable of being deposited) to land ink drops on the region capable of being deposited during a scan of being shifted from one end of recording material P to the other end of recording material P along the Y direction in FIG. 1 by drive of a head scanning means.

After the above-described scan is performed appropriate times to eject UV curable ink toward one of a region capable of being deposited, recording material P is shifted from this side to the interior direction of FIG. 1 by a shifting means and UV ink is ejected toward the next region capable of being deposited adjacent along the interior direction of FIG. 1 against the above-described region capable of being deposited by recording head 3 while performing a scan by a shifting head scanning means again.

By repeating the above-described operations to eject UV curable ink from recording head 3 by a head scanning means and a transfer means in combination, an image is formed on recording material P.

Irradiation means 4 is constituted of an ultraviolet lamp, which emits ultraviolet rays of a specific wavelength region at stable exposure energy, and a filter, which transmits ultraviolet rays of a specific wavelength region.

In the invention according to Items (1)-(16), since it is preferable to cure relatively large quantity of ink such as 5 $g/m^2$ at one time, irradiation means 4 is preferably a light source having a high illuminance.

Irradiation means 4 is provided with a form approximately same as the maximum one of the region, which can be set by recorder 1 among regions capable of being deposited by UV curable ink ejected by recording head 3 in one time scan by drive of a head scanning means, or larger than a region capable of being deposited.

Irradiation means 4 is arranged by being fixed in nearly parallel to recording material P on the both sides of head carriage 2.

As described before, as a means to adjust illuminance at the ink ejection portion, the whole of recording head 3 is naturally light shielded; in addition to this, it is effective to set distance h2 between ink ejection portion 31 of recording head 3 and recording material P larger than distance h1 between irradiation means 4 and recording material P (h1<h2), or to make distance d between recording head and irradiation means 4 remote (make d large). Further, it is more preferable to provide bellows structure 7 between recording head 3 and irradiation means 4.

Herein, the wavelength irradiated by irradiation means 4 can be appropriately varied by changing an ultraviolet lamp or a filter which are arranged in irradiation means 4.

As described above, to form a high precision image, in a serial print method, ink having been ejected from a recording head is irradiated by actinic rays from an irradiation means attached on a carriage in an early timing as possible after ink deposition, within 0.001-2.0 seconds and more preferably within 0.001-1.0 second.

An image forming method according to the invention described in Items (1)-(16) is specifically useful when an image is formed by use of a line head method recorder.

FIG. 2 is an over view to show another example of a constitution of the primary portion of a recorder according to the invention described in Items (1)-(16). An ink-jet recording device shown in FIG. 2 is called as a line head method, and plural sets of ink-jet recording head 3 of each color are fixing arranged on head carriage 2 so as to cover the whole width of recording material P.

On the other hand, on the down stream of head carriage 2, irradiation means 4 is arranged similarly so as to cover the whole width of recording material P and to cover the whole ink printing region. As an ultraviolet lamp utilized for irradiation means 4, one similar to those described in FIG. 1 can be employed.

In this line head method, head carriage 2 and irradiation means 4 are fixed, and only recording material P is transferred to form an image by ink ejection and curing. Therefore, since a thick ink layer having been formed after each color ink deposition has to be photo-cured at a time (in this example, light irradiation is performed after completion of printing by each color ink ejection on a substrate), an image forming method, in which ink quantity as large as not less than 5 g/m$^2$ is cured by one time light irradiation, as the invention described in Items (1)-(16), is specifically preferred.

Figure 3:
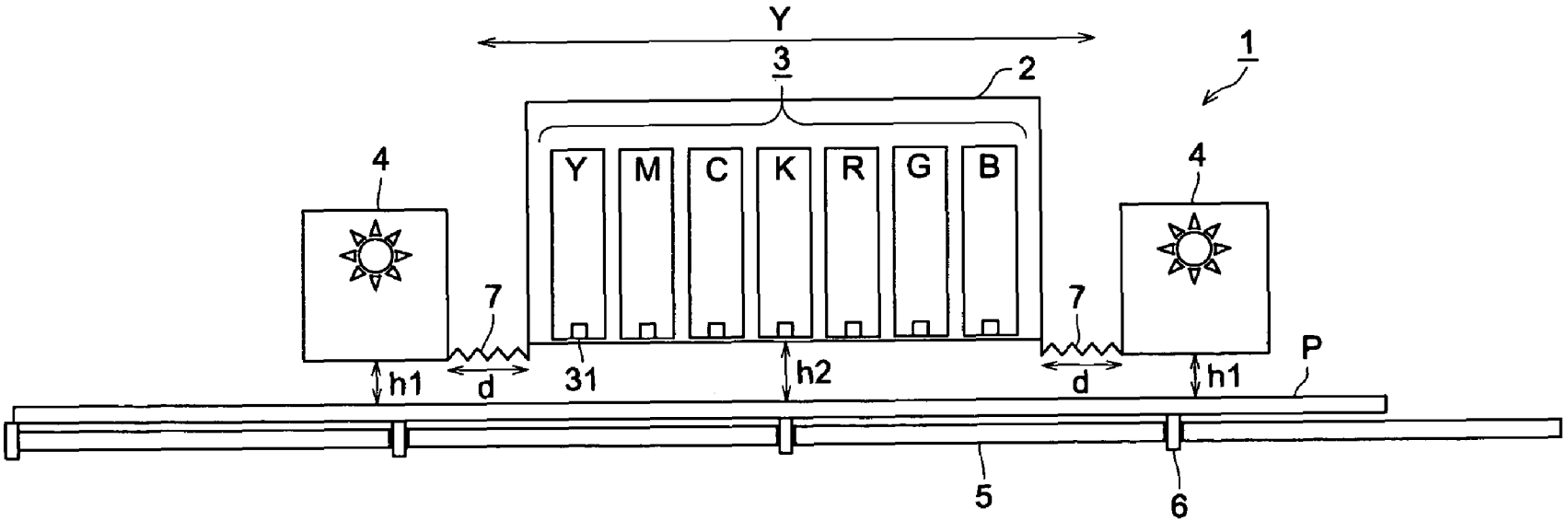
FIG. 3 shows a constitution of the primary portion of another ink-jet recording device of this invention.
Figure 4:
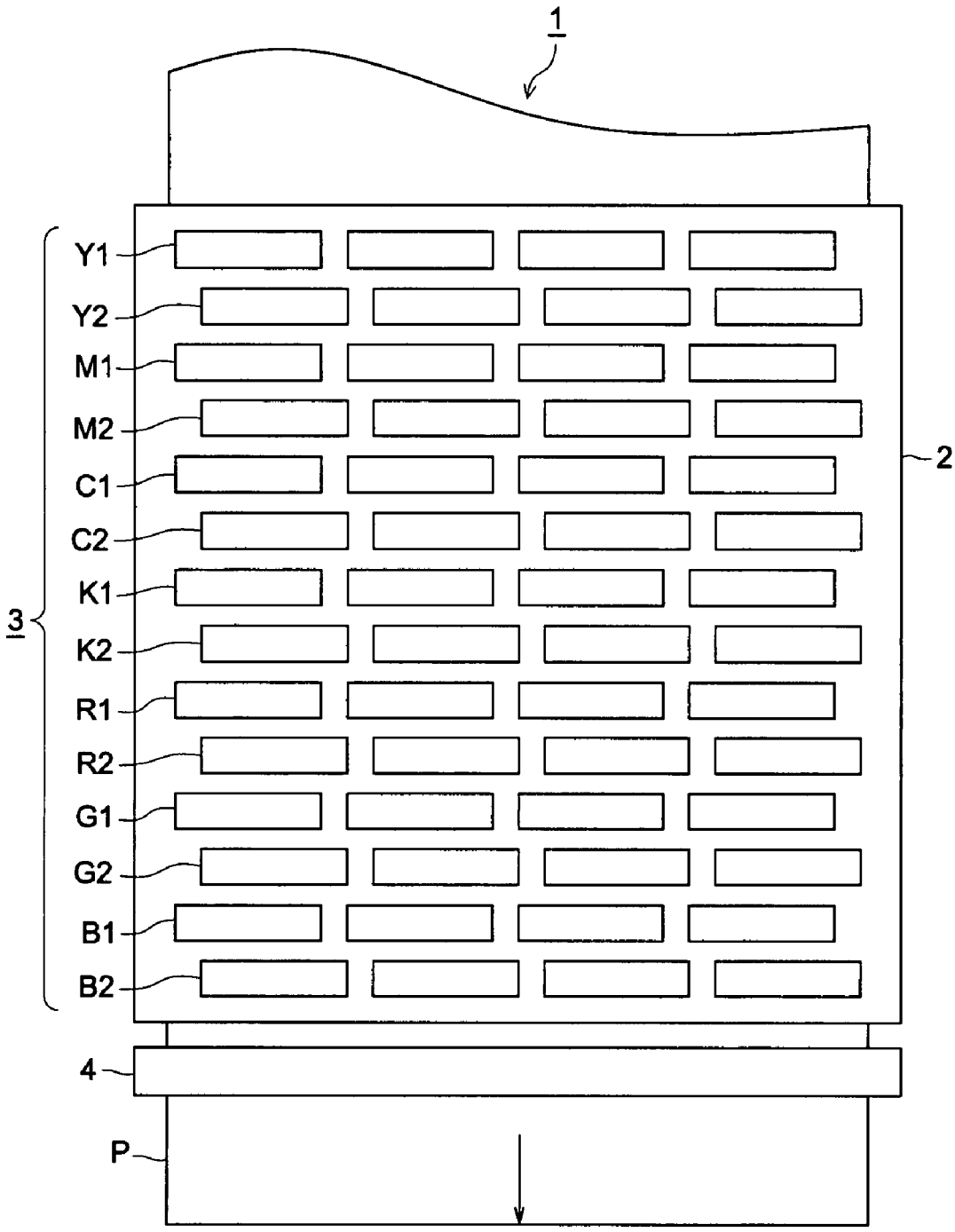
FIG. 4 shows a constitution of the primary portion of still another ink-jet recording device of this invention.
Figure 5:
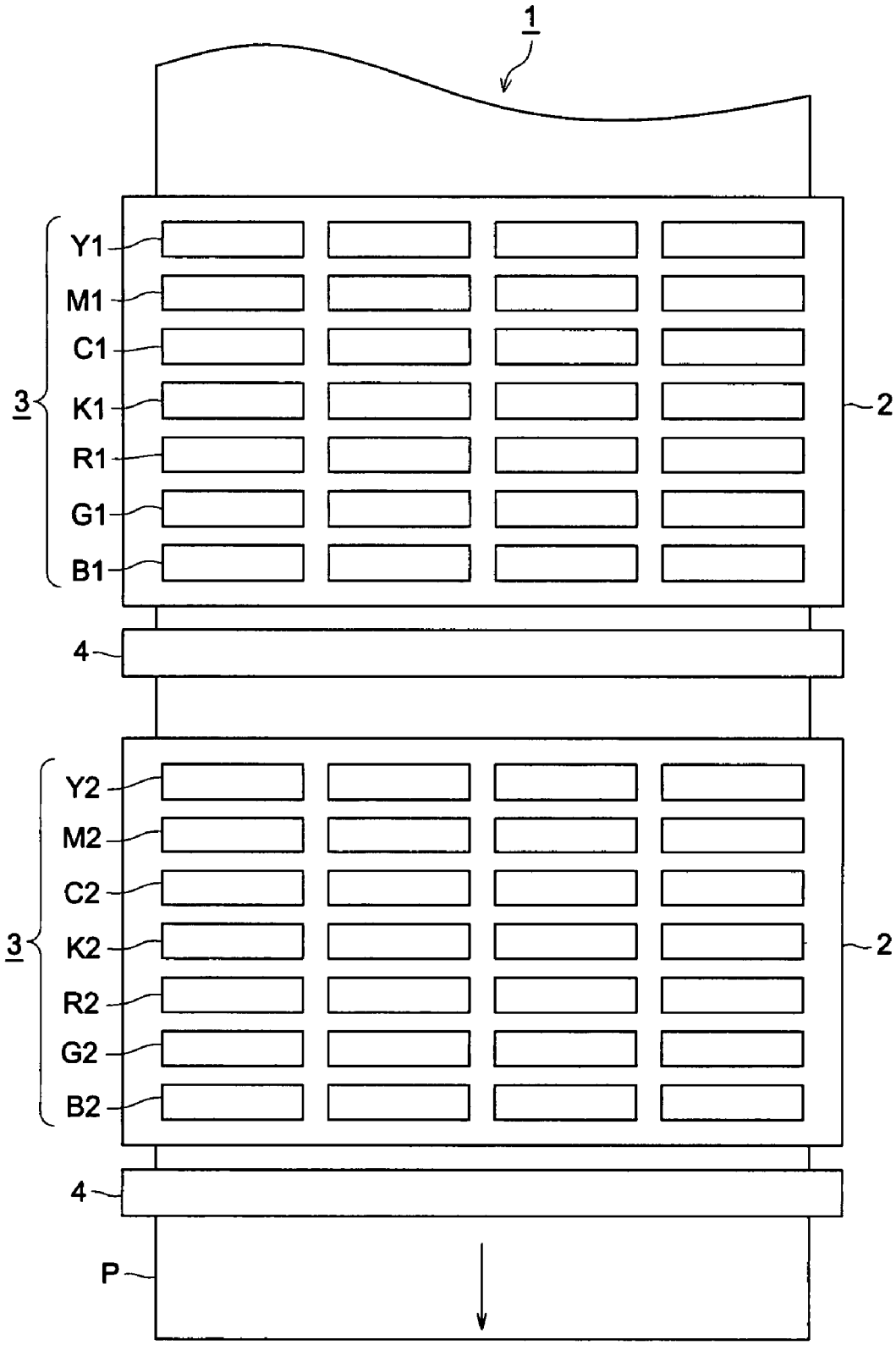
FIG. 5 shows a constitution of the primary portion of yet another ink-jet recording device of this invention.

Next, an ink-jet recording device according to the invention described in Items (17)-(23) will be explained appropriately referring to the drawings (FIGS. 3-5).

Herein, a recorder of the drawings is only an embodiment of a recorder according to the invention described in Items (17)-(23), and a recorder of this invention is not limited to these drawings.

FIG. 3 is a front view to show a constitution of the primary portion of a recorder according to the invention described in Items (17)-(23). Recorder 1 is constituted of such as head carriage 2, recording head 3, irradiation means 4 and platen portion 5. In this recorder 1, platen portion 5 is arranged under substrate P. Platen portion 5 is provided with a function to absorb ultraviolet rays and absorbs excess ultraviolet rays having passed through substrate P. As a result, an image having a high precision is stably reproduced.

Substrate (being a recording material) P is guided by guide member 6 to be transferred from this side to the interior of FIG. 3 by operation of a transfer means (not shown in the drawing). A head scanning means (not shown in the drawing) scans recording head 3 held by head carriage 2 by shifting head carriage 2 back and forth along the Y direction in FIG. 3.

Head carriage 2 is arranged over substrate P and stores a plural number of recording head 3 corresponding to the number of colors utilized for image printing on substrate P so as to arrange the ejection outlet downward. Head carriage 2 is arranged against a recorder 1 main body in a state of freely going and returning along Y direction in FIG. 3 and is shifted back and forth along Y direction in FIG. 3 by operation of a head scanning means.

Herein, in FIG. 3, head carriage 2 is drawn so as to store recording head 3 of Y, M, C, K, R, G and B, however, in practical use, a number of colors of recording head 3 to be stored in head carriage 2 can be appropriately determined.

Recording head 3 ejects ultraviolet curable ink, which has been supplied from an ink supply means (not shown in the drawing) toward substrate P through an ejection outlet by operation of an ejection means (not shown in the drawing), a plural number of which are stored in the recording head. Ultraviolet curable ink ejected from recording head 3 is comprised of such as a colorant, a polymerizing compound and a photo-polymerization initiator, and provided with a capability of curing by cross-linking or a polymerization reaction of the polymerizing compound accompanied with catalytic action of the photo-polymerization initiator by receiving irradiation of ultraviolet rays.

Recording head 3 ejects ultraviolet curable ink as ink drops on a predetermined region (a region capable of being deposited) to land ink drops on said region capable of being deposited during a scan of being shifted from one end of substrate P to the other end of substrate P along the Y direction in FIG. 3 by drive of a head scanning means.

After the above-described scan is appropriately performed for several times to eject ultraviolet curable ink toward one portion of a region capable of being deposited, substrate P is appropriately transferred from this side to the interior direction in FIG. 3 by a transfer means, and ultraviolet curable ink is ejected toward the next region capable of being deposited adjacent to the above-described region capable of being deposited along the interior direction in FIG. 3 by recording head 3 while scanning by a head scan means is again performed.

By repeating the above operation and ejecting ultraviolet curable ink from recording head 3 synchronous with a head scan means and a transfer means, an image comprising aggregate of ultraviolet curable ink drops is formed on substrate P.

Irradiation means 4 is constituted of an ultraviolet lamp which emits ultraviolet rays of a specific wavelength region at stable exposure energy and a filter which transmits ultraviolet rays of a specific wavelength. Herein, as an ultraviolet lamp, such as a mercury lamp and a metal halide lamp, which are described before, are applicable, and a metal halide tube, a cold cathode tube and a mercury tube of a band form are preferable.

Irradiation means 4 is provided with a form same as the maximum one, which can be set by recorder (ultraviolet curable ink-jet printer) 1 among regions capable of being deposited on which ultraviolet curable ink is ejected by recording head 3 in one time of scan by drive of head scan means, or a form larger than a region capable of being deposited.

Irradiation means 4 is fixing arranged approximately parallel against substrate P on the both sides of head carriage 2.

As described before, as a means to adjust illuminance at the ink ejection portion, it is effective to light shield the whole recording head 3, or to adjust distance h1 between irradiation means 4 and substrate P, distance h2 between ink ejection portion 31 of recording head 3 and substrate 3, and distance d between recording head 3 and irradiation means 4. Further, bellows structure 7 between recording head and irradiation means 4 is also preferable.

Further, the wavelength of ultraviolet rays irradiated by irradiation means 4 can be appropriately varied by changing an ultraviolet lamp or a filter which is arranged in irradiation means 4.

FIG. 4 is a drawing to show another example of a constitution of the primary portion of an ink-jet recording device.

An ink-jet recording device shown in FIG. 4 is called as a line head method, and a plural number of recording head 3 of each color are fixing arranged in head carriage 2 so as to cover the whole width of substrate P. Head carriage 2 is light shielded.

On the other hand, on the down stream of head carriage 2, irradiation means 4 is arranged similarly so as to cover the whole width of recording material P and to cover the whole ink printing region. As an ultraviolet lamp utilized for irradiation means 4, similar one to those described in FIG. 1 can be employed.

In this line head method, head carriage 2 and irradiation means 4 are fixed and only substrate P is transported and an image is formed by performing ink ejection and curing.

EXAMPLES

In the following, this invention will be specifically explained referring to examples, however, is not limited thereto.

Example 1

An Example Corresponding to the Invention Described in Items (1)-(16)

Preparation of Curing Composition

A photo-polymerizable compound, a photo-polymerization initiator, a compound according to this invention and other additives were incorporated and dissolved, whereby actinic ray curable compositions as shown in following Tables 4 and 5 were prepared.

TABLE 4

| Curing composition No. | | | | Photo-polymerizable compound: radical polymerizing monomer | Photo-polymerization initiator | Perfume | Surfactant | Dispersant | Pigment | Remarks |
|---|---|---|---|---|---|---|---|---|---|---|
| 1 | Compound name | *1 | *2 | Phenoxyethyl methacrylate | Irgacure 184 | Linalool | KF-351 | PB822 | Pigment of each color | Comp. |
| | Addition amount (weight %) | 40 | 20 | 25.8 | 10 | 0.1 | 0.1 | 1 | 3 | |
| 2 | Compound name | *1 | *2 | Phenoxyethyl methacrylate | Irgacure 184 | Linalool | KF-351 | PB822 | Pigment of each color | Inv. |
| | Addition amount (weight %) | 38 | 20 | 33.8 | 4 | 0.1 | 0.1 | 1 | 3 | |

*1: Tetraethyleneglycol diacrylate
*2: ϵ-caprolactam-modified dipentaerythritol hexaacrylate
Inv.: Invention,
Comp.: Comparison

TABLE 5-1

| Curing composition No. | | Photo-polymerizable compound: Compound having an oxetane ring | | | Oxirane compound | Photo-polymerization initiator | Basic compound |
|---|---|---|---|---|---|---|---|
| 3 | *1 | OXT221 | OXT101 | OXT212 | Celloxide 2021P | UVI6992 | Tributylamine |
| | *2 | 50 | 3 | 7 | 23.6 | 10 | 1 |
| 4 | *1 | OXT221 | OXT101 | OXT212 | Celloxide 2021P | UVI6992 | Tributylamine |
| | *2 | 50 | 3 | 12 | 23.6 | 5 | 1 |
| 5 | *1 | OXT221 | OXT101 | OXT212 | Celloxide 2021P | UVI6992 | Tributylamine |
| | *2 | 50 | 3 | 14 | 23.6 | 3 | 1 |
| 6 | *1 | OXT221 | OXT101 | OXT212 | Celloxide 2021P | S-5 | Tributylamine |
| | *2 | 50 | 3 | 15 | 23.6 | 2 | 1 |
| 7 | *1 | OXT221 | OXT101 | OXT212 | Celloxide 2021P | S-5 | Tributylamine |
| | *2 | 50 | 3 | 5 | 33.6 | 2 | 1 |
| 8 | *1 | OXT221 | OXT101 | OXT212 | EP-1 | I-3 | Tributylamine |
| | *2 | 50 | 3 | 7.9 | 23.7 | 8 | 1 |
| 9 | *1 | OXT221 | OXT101 | OXT212 | EP-1 | I-3 | Tributylamine |
| | *2 | 50 | 3 | 13.1 | 23.5 | 4 | 1 |
| 10 | *1 | OXT221 | OXT101 | OXT212 | EP-1 | I-3 | Tributylamine |
| | *2 | 50 | 3 | 3.1 | 33.5 | 4 | 1 |
| 11 | *1 | OXT221 | OXT101 | OXT212 | EP-1 | I-3 | Tributylamine |
| | *2 | 50 | 3 | 15.1 | 23.5 | 2 | 1 |

*1: Comound name, 2: Added amount (weight %)
*Sumilizer MDP-S: 2,2'-methylenebis (4-methyl-6-tert-butylphenol) manufactured by Sumitomo Chemical Co., Ltd.

TABLE 5-2

| Curing composition No. | Perfume | Surfactant | Dispersant | Pigment | Others | | Remarks |
|---|---|---|---|---|---|---|---|
| 3 | Linalool | KF-351 | PB822 | Pigment of each color | Sumirizer MDP-1 | Water | Comparison |
| | 0.1 | 0.1 | 1 | 3 | 0.2 | 1 | |
| 4 | Linalool | KF-351 | PB822 | Pigment of each color | Sumirizer MDP-1 | Water | Invention |
| | 0.1 | 0.1 | 1 | 3 | 0.2 | 1 | |
| 5 | Linalool | KF-351 | PB822 | Pigment of each color | Sumirizer MDP-1 | Water | Invention |
| | 0.1 | 0.1 | 1 | 3 | 0.2 | 1 | |

TABLE 5-2-continued

| Curing composition No. | Perfume | Surfactant | Dispersant | Pigment | Others | | Remarks |
|---|---|---|---|---|---|---|---|
| 6 | Linalool | KF-351 | PB822 | Pigment of each color | Sumirizer MDP-1 | Water | Invention |
| | 0.1 | 0.1 | 1 | 3 | 0.2 | 1 | |
| 7 | Linalool | KF-351 | PB822 | Pigment of each color | Sumirizer MDP-1 | Water | Invention |
| | 0.1 | 0.1 | 1 | 3 | 0.2 | 1 | |
| 8 | Linalool | KF-351 | PB822 | Pigment of each color | Sumirizer MDP-1 | Water | Comparison |
| | 0.1 | 0.1 | 1 | 3 | 0.2 | 1 | |
| 9 | Linalool | KF-351 | PB822 | Pigment of each color | Sumirizer MDP-1 | Water | Invention |
| | 0.1 | 0.1 | 1 | 3 | 0.2 | 1 | |
| 10 | Linalool | KF-351 | PB822 | Pigment of each color | Sumirizer MDP-1 | Water | Invention |
| | 0.1 | 0.1 | 1 | 3 | 0.2 | 1 | |
| 11 | Linalool | KF-351 | PB822 | Pigment of each color | Sumirizer MDP-1 | Water | Invention |
| | 0.1 | 0.1 | 1 | 3 | 0.2 | 1 | |

*Sumilizer MDP-S: 2,2'-methylenebis(4-methyl-6-tert-butylphenol) manufactured by Sumitomo Chemical Co., Ltd.

The utilized compounds are described below.

[Photo-polymerizable Compound]

(Oxyrane Compound)

Celloxide 2021P: produced by Daicel Chemical Industries Ltd.

(Compound Having Oxetane Ring)

OXT221: OXT-221 (produced by Toagosei Co., Ltd.), di[1-ethyl(3-oxetanyl)]methyl ether (Exemplary compound 24)

OXT212: OXT-212 (produced by Toagosei Co., Ltd.), 3-ethyl-3-(2-ethylhexyloxymethyl)oxetane OXT101: OXT-101 (produced by Toagosei Co., Ltd.), 3-ethyl-3-hydroxymethyloxetane

[Photo-Polymerization Initiator]

Uv16992: produced by The Dow Chemicals Co., propione carbonate 50% solution

Irgacure 184: produced by Ciba Specialty Chemicals

[Perfume]

Linalool

[Surfactant]

KF-351: silicone oil (produced by Shin-Etsu Chemical Co., Ltd.)

[Dispersant]

PB822: produced by Ajinomoto Fine-Techno Co., Inc.

[Others]

Sumirizer-MDP-S: produced by Sumitomo Chemical Co., Ltd., 2,2'-methylenebis(4-methyl-6-tert-butylphenol)

That is, a dispersant (PB822, manufactured by Ajinomoto Fine-Techno Co., Inc.), each photo-polymerizable compound, described in Tables 4 and 5 were charged in a stainless beaker, the mixture being dissolved by stirring and mixing while being heated on a hot plate of 65° C., and successively, the resulting solution, after having been added with pigment, was pored into a polyethylene bottle together with zirconia beads having a diameter of 1 mm to be sealed, followed by being subjected to a dispersion treatment for 2 hours by use of a paint shaker. Next, zirconia beads were eliminated, each of various additives such as a polymerization initiator, an acid multiplier, a basic compound and a surfactant being added as a combination described in Tables 4 and 5, and the resulting mixture was filtered by a 0.8 μm membrane filter to prevent printer clogging, whereby actinic ray curable compositions were prepared.

As pigment, utilized was the following pigment. That is, as pigment in each actinic ray curable composition of the aforesaid tables, the following K, C, M and Y pigments were utilized to prepare 7 types ink comprising K, C, M, Y, Lk, Lc, and Lm, which are combined to be one ink set, and image formation was performed by utilizing each ink set 1-11 to be evaluated. Herein, with respect to ink of Lk, Lc and Lm, a pigment concentration in ink was set to ⅕ and the reduced portion was controlled by a photo-polymerizable compound.

[Pigment]

K; CI Pigment Black 7

C; CI Pigment Blue 15:3

M; CI Pigment Red 57:1

Y; CI Pigment Yellow 13

<Ink-jet Image Forming Method>

On an ink-jet recording device having a constitution described in FIG. 1 which is equipped with a piezo type ink-jet nozzle, an ink set prepared which was prepared from each curable composition described above was mounted and the following image recording was continuously performed on a long length recording material having a width of 600 mm and a length of 20 m. Ink supply system was constituted of an ink tank, a supply tube, a pre-room ink tank immediately before the head, a piping with a filter and a piezo head, and a portion from the pre-room tank to the head was heat-insulated and heated at 50° C. Herein, the head portion was heated corresponding to a viscosity of each curable composition ink and driven so as to eject multi-size dot of a liquid drop quantity of 2-15 pl at a resolution of 720×720 dpi, whereby the above-described ink prepared from the above described curable composition was continuously ejected. Further, a recording material was heated at 40° C. by a plane heater. Ink-jet ink, after deposition, was irradiated with a ultraviolet rays of 300 mJ/cm$^2$ and cured in a moment (less than 0.5 seconds after deposition), by use of metal halide lamps on the both sides of a carriage. Ink ejection quantity was adjusted so as to make ink quantity, which is subjected to one time of UV irradiation, of the quantity described in FIG. 6. Herein, in ink-jet image formation, printing was performed according to the above-described method under an environment of 30° C. and 80% RH.

Herein, illuminance of each irradiation light source was measured by use of UVPF-A1 manufactured by Iwasaki Electric Co., Ltd. as accumulated illuminance at. 254 nm.

Further, the following 2 types were utilized as a recording material.

Synthetic Paper: UPO FSG, synthetic paper produced by UPO Corp.

PVC: polyvinyl chloride

<Evaluation of Curing Capability>

After image formation on each sheet of recording material, with respect to each image, the cured image is scratched with a finger nail to judge curing based on whether a layer can be peeled off, or not and presence of wrinkles.

A: No problem with respect to curing without wrinkles.

B: Few wrinkles are generated, however, no problem due to curing.

C: Wrinkles were present, however, there was no peeling-off of the cured layer, being at the lowest viable level.

D: Wrinkles were generated and peeling resulted to an unviable degree.

TABLE 6

| Sample No. | Layer thickness ($g/m^2$) 3 | 5 | 10 |
|---|---|---|---|
| 1 | A | C | D |
| 2 | A | A | A |
| 3 | A | D | D |
| 4 | A | B | C |
| 5 | A | B | B |
| 6 | A | A | B |
| 7 | A | A | A |
| 8 | A | D | D |
| 9 | A | A | B |
| 10 | A | A | A |
| 11 | A | A | A |

221: Aronoxetane OXT-221 (being a bi-functional polymerizable compound, produced by Toa Gosei Co., Ltd.)

Compound 1: a bi-functional polymerizable compound

Compound 2: a photo-polymerization initiator

PY180: C. I. Pigment Yellow 180

PR122: C. I. Pigment Red 122

PB15: C. I. Pigment Blue 15:4

PG7: C. I. Pigment Green 7

PBk7: C. I. Pigment Black 7

PB822: Ajisper PB822 (being a dispersant, produced by Ajinomoto Finetechno Co., Ltd.)

TPA: tri-isopropanol amine (being a polymerization inhibitor)

Compound 1

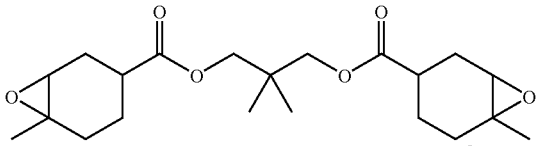

Compound 2

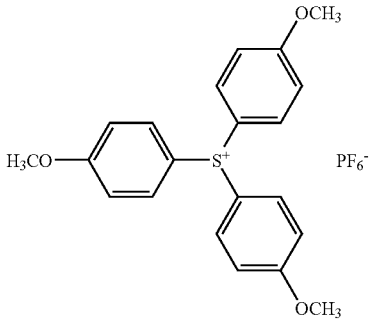

TABLE 7

| Ink | 212 | 101 | 221 | 5903 | 5937 | PY180 | PR122 | PB15:4 | PG7 | PBk7 | PB822 | TPA | Pure water |
|---|---|---|---|---|---|---|---|---|---|---|---|---|---|
| Y | 7.0 | 3.0 | 62.0 | 18.0 | 4.0 | 3.5 | | | | | 1.4 | 0.1 | 1.0 |
| M | 7.0 | 3.0 | 64.1 | 18.0 | 4.0 | | 2.0 | | | | 0.8 | 0.1 | 1.0 |
| C | 7.0 | 3.0 | 64.1 | 18.0 | 4.0 | | | 2.0 | | | 0.8 | 0.1 | 1.0 |
| K | 7.0 | 3.0 | 61.3 | 18.0 | 4.0 | | | | | 4.0 | 1.6 | 0.1 | 1.0 |
| R | 7.0 | 3.0 | 61.3 | 18.0 | 4.0 | | 4.0 | | | | 1.6 | 0.1 | 1.0 |
| G | 7.0 | 3.0 | 62.7 | 18.0 | 4.0 | | | | 3.0 | | 1.2 | 0.1 | 1.0 |
| B | 7.0 | 3.0 | 62.0 | 18.0 | 4.0 | | | 3.5 | | | 1.4 | 0.1 | 1.0 |

It is clear from Table 6 that samples of this invention do not exhibit wrinkle generation nor peeling, resulting in no deterioration of curing capability even when any recording material is utilized.

Example 2

An Example Corresponding to the Invention Described in Items (17)-(23)

[Preparation of Ink]

The composition described in following Table 7 was mixed under heating (40° C.) while shielded from light, and filtered through a 1 μm filter to prepare ink Y, ink M, ink C, ink K, ink R, ink G and ink B.

The following numeral designations are used in the table.

101: Aronoxetane OXT-101 (being a mono-functional polymerizable compound, produced by Toa Gosei Co., Ltd.)

212: Aronoxetane OXT-212 (being a mono-functional polymerizable compound, produced by Toa Gosei Co., Ltd.)

[Ink-jet Recording Method I: One Time Exposure of All Colors-Line Recording]

The above described ink was loaded into an on-demand type ink-jet printer as shown in FIG. 4, being an ink-jet recording device, on which a piezo type ink-jet head for 7 colors, in which 2 sets of heads for each color having a nozzle pitch of 360 dpi were combined to obtain a line head of 720 dpi, was mounted. Further from color data (before conversion) of Y, M, C and K sent to a specific pixel based on image data separated into 4 colors of Y, M, C and K ink (after conversion) utilized for the pixel was determined based on conversion tables 1 and 2 described in following Tables 8 and 9, whereby solid images were formed at a resolution of 720×720 dpi and at liquid volume of 8 pl per pixel by use of 7 colors of ink, comprising Y, M, C, K, R, G and B. "dpi" means dots per inch, or per 2.54 cm. The ink, after having been deposited, was irradiated and cured by irradiation from a high pressure mercury lamp VZero085 (manufactured by Integration Technology Corp.) within 1 second after ink deposition.

TABLE 8

| | Before conversion | | | | After conversion | | | | | | | |
|---|---|---|---|---|---|---|---|---|---|---|---|---|
| Color | Y | M | C | K | Y | M | C | K | R | G | B | Total output |
| 1 | 0 | 0 | 0 | 0 | 0 | 0 | 0 | 0 | 0 | 0 | 0 | 0 |
| 2 | 1 | 0 | 0 | 0 | 1 | 0 | 0 | 0 | 0 | 0 | 0 | 1 |
| 3 | 0 | 1 | 0 | 0 | 0 | 1 | 0 | 0 | 0 | 0 | 0 | 1 |
| 4 | 0 | 0 | 1 | 0 | 0 | 0 | 1 | 0 | 0 | 0 | 0 | 1 |
| 5 | 0 | 0 | 0 | 1 | 0 | 0 | 0 | 0.7 | 0 | 0 | 0 | 0.7 |
| 6 | 1 | 1 | 0 | 0 | 0 | 0 | 0 | 0 | 1 | 0 | 0 | 1 |
| 7 | 1 | 0 | 1 | 0 | 0 | 0 | 0 | 0 | 0 | 1 | 0 | 1 |
| 8 | 1 | 0 | 0 | 1 | 0.7 | 0 | 0 | 0.3 | 0 | 0 | 0 | 1 |
| 9 | 0 | 1 | 1 | 0 | 0 | 0 | 0 | 0 | 0 | 0 | 1 | 1 |
| 10 | 0 | 1 | 0 | 1 | 0 | 0.7 | 0 | 0.3 | 0 | 0 | 0 | 1 |
| 11 | 0 | 0 | 1 | 1 | 0 | 0 | 0.7 | 0.3 | 0 | 0 | 0 | 1 |
| 12 | 1 | 1 | 1 | 0 | 0 | 0 | 0 | 0.7 | 0 | 0 | 0 | 0.7 |
| 13 | 1 | 1 | 0 | 1 | 0 | 0 | 0 | 0.3 | 0.7 | 0 | 0 | 1 |
| 14 | 1 | 0 | 1 | 1 | 0 | 0 | 0 | 0.3 | 0 | 0.7 | 0 | 1 |
| 15 | 0 | 1 | 1 | 1 | 0 | 0 | 0 | 0.3 | 0 | 0 | 0.7 | 1 |
| 16 | 1 | 1 | 1 | 1 | 0 | 0 | 0 | 1 | 0 | 0 | 0 | 1 |

0: non-record,
1: record

TABLE 9

| | Before conversion | | | | After conversion | | | | | | | |
|---|---|---|---|---|---|---|---|---|---|---|---|---|
| Color | Y | M | C | K | Y | M | C | K | R | G | B | Total output |
| 1 | 0 | 0 | 0 | 0 | 0 | 0 | 0 | 0 | 0 | 0 | 0 | 0 |
| 2 | 1 | 0 | 0 | 0 | 1 | 0 | 0 | 0 | 0 | 0 | 0 | 1 |
| 3 | 0 | 1 | 0 | 0 | 0 | 1 | 0 | 0 | 0 | 0 | 0 | 1 |
| 4 | 0 | 0 | 1 | 0 | 0 | 0 | 1 | 0 | 0 | 0 | 0 | 1 |
| 5 | 0 | 0 | 0 | 1 | 0 | 0 | 0 | 1 | 0 | 0 | 0 | 1 |
| 6 | 1 | 1 | 0 | 0 | 1 | 1 | 0 | 0 | 0 | 0 | 0 | 2 |
| 7 | 1 | 0 | 1 | 0 | 1 | 0 | 1 | 0 | 0 | 0 | 0 | 2 |
| 8 | 1 | 0 | 0 | 1 | 1 | 0 | 0 | 1 | 0 | 0 | 0 | 2 |
| 9 | 0 | 1 | 1 | 0 | 0 | 1 | 1 | 0 | 0 | 0 | 0 | 2 |
| 10 | 0 | 1 | 0 | 1 | 0 | 1 | 0 | 1 | 0 | 0 | 0 | 2 |
| 11 | 0 | 0 | 1 | 1 | 0 | 0 | 1 | 1 | 0 | 0 | 0 | 2 |
| 12 | 1 | 1 | 1 | 0 | 0.3 | 0.3 | 0.3 | 1 | 0 | 0 | 0 | 1.9 |
| 13 | 1 | 1 | 0 | 1 | 1 | 1 | 0 | 0.5 | 0 | 0 | 0 | 2.5 |
| 14 | 1 | 0 | 1 | 1 | 1 | 0 | 1 | 0.5 | 0 | 0 | 0 | 2.5 |
| 15 | 0 | 1 | 1 | 1 | 0 | 1 | 1 | 0.5 | 0 | 0 | 0 | 2.5 |
| 16 | 1 | 1 | 1 | 1 | 0.5 | 0.5 | 0.5 | 1 | 0 | 0 | 0 | 2.5 |

0: non-record,
1: record

[Ink-jet Recording Method 2: Two-Fraction Exposure-Line Recording]

The above described ink was loaded in an on-demand type ink-jet printer, shown in FIG. 5, serving as an ink-jet recording device, on which a piezo type 7 color ink-jet head, in which a head unit for all colors having a nozzle pitch of 360 dpi and a light source were arranged, and further another head unit for all colors and another light source were arranged while being shifted by 360 dpi along scan direction from the aforesaid head unit and light source to make a line head equivalent to 720 dpi, was mounted, and from color data (before conversion) of Y, M, C and K sent to a certain pixel, based on image data separated into the 4 colors of Y, M, C, and K ink (after conversion) utilized for the pixel was determined according to conversion tables 1 and 2 described in above Tables 8 and 9, whereby solid images were formed at a resolution of 720×720 dpi and at liquid volume of 8 pl per pixel using 7 color ink comprising Y, M, C, K, R, G and B. The ink, within 1 second after ink deposition, was irradiated and cured by irradiation from a high pressure mercury lamp VZero085 (manufactured by Integration Technology Corp.).

[Ink-jet Recording Method 3: Two-fraction Exposure-2 Pass Serial Recording]

The above described ink was loaded in an on-demand type ink-jet printer serving as an ink-jet recording device as shown in FIG. 3, on which a 7-color piezo type ink-jet head was mounted, which was provided with a head of nozzle pitch of 360 dpi, light sources being arranged on both sides of the head, and has a resolution corresponding to 720 dpi based on 2 reciprocating passes, and from color data (before conversion) of Y, M, C, and K sent to any specific pixel based on image data separated into the 4 colors of Y, M, C, and K ink (after conversion) utilized for the pixel was determined using conversion tables 1 and 2 described in above Tables 8 and 9, whereby solid images were formed at a resolution of 720×720 dpi and at liquid volume of 8 pl per pixel using 7 color ink comprising Y, M, C, K, R, G and B. "dpi" means dots per inch, or per 2.54 cm. The ink, 1 second after ink deposition, cured by irradiation from a high pressure mercury lamp, such as VZero085 (manufactured by Integration Technology Corp.).

[Measurement and Evaluation]

(Ultraviolet Transmittance)

Solid images were formed by above-described ink-jet recording methods 1-3 (herein, cured via high pressure mercury lamp VZero085 was not employed) by utilizing a polypropylene substrate, and ultraviolet transmittance per pixel at an absorption peak wavelength (280 nm) of a photopolymerization initiator was measured with a spectrophotometer having an aperture of 10 mmϕ. The obtained results are shown in Table 10.

TABLE 10

| | Conversion Table 1 | | | Conversion Table 2 | | |
|---|---|---|---|---|---|---|
| | | Ultraviolet transmittance (%) | | | Ultraviolet transmittance (%) | |
| Color | Total output | Recording method 1 | Recording methods 2 and 3 | Total output | Recording method 1 | Recording methods 2 and 3 |
| 1 | 0 | 100 | 100 | 0 | 100 | 100 |
| 2 | 1 | 0.6 | 7.8 | 1 | 0.6 | 7.8 |
| 3 | 1 | 0.3 | 5.7 | 1 | 0.3 | 5.7 |
| 4 | 1 | 1.2 | 11.0 | 1 | 1.2 | 11.0 |
| 5 | 0.7 | 0.8 | 9.0 | 1 | 0.1 | 3.2 |
| 6 | 1 | 0.1 | 3.5 | 2 | <0.01 | 0.4 |
| 7 | 1 | 0.3 | 5.6 | 2 | <0.01 | 0.9 |
| 8 | 1 | 0.4 | 5.9 | 2 | <0.01 | 0.3 |
| 9 | 1 | 0.7 | 8.1 | 2 | <0.01 | 0.6 |
| 10 | 1 | 0.2 | 4.8 | 2 | <0.01 | 0.2 |
| 11 | 1 | 0.6 | 7.6 | 2 | <0.01 | 0.4 |
| 12 | 0.7 | 0.8 | 9.0 | 1.9 | <0.01 | 0.3 |
| 13 | 1 | 0.1 | 3.4 | 2.5 | <0.01 | 0.1 |
| 14 | 1 | 0.2 | 4.7 | 2.5 | <0.01 | 0.2 |
| 15 | 1 | 0.4 | 6.1 | 2.5 | <0.01 | 0.1 |
| 16 | 1 | 0.1 | 3.2 | 2.5 | <0.01 | 0.3 |

[Evaluation]

Images were formed by above-described ink-jet recording methods 1-3 utilizing synthetic paper (UPO FGS, synthetic paper produced by UPO Corp.) as a substrate, and evaluation of the following was performed.

<Curing Wrinkles>

The solid image portions were visually observed and evaluated based on the following criteria.

A: No observed decrease of gloss due to curing wrinkles in the solid image portions.

B: A slight observed decrease of gloss due to curing wrinkles in the solid image portions.

C: A definite observed decrease of gloss due to curing wrinkles in the solid image portions.

<Adhesion>

Cellotape (being a registered trade mark) of a width of 25 mm, after having been firmly adhered onto the surface of solid image portions, was quickly peeled off at an angle of 90° to test for peel-off resistance based on the following criteria.

A: No peel-off of any image portion was observed.

C: Some peel-off of image portions was observed.

<Surface Texture>

The surface of a solid image portion was observed, visually and by touch, to be ranked based on the following criteria.

A: Roughened surface is barely noted by visual and tactile evaluation.

B: Slight roughness of the surface was noted by tactile evaluation, not however by visual observation, resulting in practical use.

C: Granularity of the surface was obvious by visual and tactile evaluation, resulting in non-viability for practical use.

The results of these evaluations are shown in Tables 11 and 12.

TABLE 11

| | | Recording method 1 | | | Recording method 2 | | | Recording method 3 | | |
|---|---|---|---|---|---|---|---|---|---|---|
| Color | Conversion table | Curing wrinkles | Ad-hesion | Surface texture | Curing wrinkles | Ad-hesion | Surface texture | Curing wrinkles | Ad-hesion | Surface texture |
| 1 | 1 | — | — | — | — | — | — | — | — | — |
| 2 | 1 | A | A | A | A | A | A | A | A | A |
| 3 | 1 | A | A | A | A | A | A | A | A | A |
| 4 | 1 | A | A | A | A | A | A | A | A | A |
| 5 | 1 | A | A | A | A | A | A | A | A | A |
| 6 | 1 | B | A | A | A | A | A | A | A | A |
| 7 | 1 | A | A | A | A | A | A | A | A | A |
| 8 | 1 | A | A | A | A | A | A | A | A | A |
| 9 | 1 | A | A | A | A | A | A | A | A | A |
| 10 | 1 | A | A | A | A | A | A | A | A | A |
| 11 | 1 | A | A | A | A | A | A | A | A | A |
| 12 | 1 | A | A | A | A | A | A | A | A | A |
| 13 | 1 | B | A | A | A | A | A | A | A | A |
| 14 | 1 | A | A | A | A | A | A | A | A | A |
| 15 | 1 | A | A | A | A | A | A | A | A | A |
| 16 | 1 | B | A | A | A | A | A | A | A | A |

TABLE 12

| | | Recording method 1 | | | Recording method 2 | | | Recording method 3 | | |
|---|---|---|---|---|---|---|---|---|---|---|
| Color | Conversion table | Curing wrinkles | Ad-hesion | Surface texture | Curing wrinkles | Ad-hesion | Surface texture | Curing wrinkles | Ad-hesion | Surface texture |
| 1 | 2 | — | — | — | — | — | — | — | — | — |
| 2 | 2 | A | A | A | A | A | A | A | A | A |
| 3 | 2 | A | A | A | A | A | A | A | A | A |
| 4 | 2 | A | A | A | A | A | A | A | A | A |
| 5 | 2 | B | A | A | A | A | A | A | A | A |
| 6 | 2 | C | B | B | B | A | B | A | A | B |
| 7 | 2 | C | B | B | A | A | B | A | A | B |
| 8 | 2 | C | B | B | A | A | B | A | A | B |
| 9 | 2 | C | B | B | A | A | B | A | A | B |
| 10 | 2 | C | B | B | A | A | B | A | A | B |
| 11 | 2 | C | B | B | A | A | B | A | A | B |
| 12 | 2 | C | B | B | A | A | B | A | A | B |
| 13 | 2 | C | C | C | B | A | C | A | A | C |
| 14 | 2 | C | C | C | A | A | C | A | A | C |
| 15 | 2 | C | C | C | B | A | C | A | A | C |
| 16 | 2 | C | C | C | A | A | C | A | A | C |

It can be proven from Tables 11 and 12 that image samples prepared by the ink-jet recording method of this invention are superior in lack of curing wrinkles, good adhesion and smooth texture than the comparative examples of other ink-jet recording methods.

The invention claimed is:

1. An ink-jet recording method comprising the steps of:

(a) ejecting plural colors of inks onto a substrate, wherein the plural colors of inks are cationic polymerizable type and (b) irradiating ultraviolet rays onto the deposited ink to cure and fix the ink to form an image, wherein uncured ink quantity on the substrate at the time of ultraviolet ray irradiation is limited to result in ultraviolet transmittance of at least 0.1% at the absorption peak wavelength of a photo-polymerization initiator contained in the ink.

2. The ink-jet recording method described in claim 1, wherein inks of seven colors comprising yellow, magenta, cyan, black, blue, green and red are utilized as the plural color inks.

3. An ink set comprising plural color inks utilized in the ink-jet recording method described in claim 1, wherein ultraviolet transmittance of a solid image with respect to each ink of all the plural colors is not less than 0.1%.

4. The ink set described in claim 3, wherein seven color inks of a yellow, magenta, cyan, black, blue, green and red ink are utilized as the plural color inks.

5. An ink-jet recording device to record an image with an ink-jet recording method described in claim 1, wherein an ink set is utilized exhibiting ultraviolet transmittance of a solid image of each ink of the plural colors to be at least 0.1%.

6. The ink-jet recording device described in claim 5, wherein the plural inks are seven color inks of yellow, magenta, cyan, black, blue, green and red.

* * * * *